US011745065B2

(12) United States Patent
Dipert et al.

(10) Patent No.: US 11,745,065 B2
(45) Date of Patent: Sep. 5, 2023

(54) IRON TYPE GOLF CLUB HEAD

(71) Applicant: Taylor Made Golf Company, Inc., Carlsbad, CA (US)

(72) Inventors: Joshua J. Dipert, Carlsbad, CA (US); Scott Taylor, Bonita, CA (US); Yong Ling, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/697,175

(22) Filed: Mar. 17, 2022

(65) Prior Publication Data

US 2022/0280845 A1 Sep. 8, 2022

Related U.S. Application Data

(63) Continuation of application No. 16/866,927, filed on May 5, 2020, now Pat. No. 11,305,165, which is a continuation of application No. 16/273,831, filed on Feb. 12, 2019, now Pat. No. 10,646,757, which is a continuation of application No. 15/956,412, filed on Apr. 18, 2018, now Pat. No. 10,245,484, which is a continuation of application No. 15/427,921, filed on Feb. 8, 2017, now Pat. No. 9,975,018, which is a (Continued)

(51) Int. Cl.
*A63B 53/04* (2015.01)
*A63B 60/54* (2015.01)

(52) U.S. Cl.
CPC ..... *A63B 53/0475* (2013.01); *A63B 53/047* (2013.01); *A63B 53/042* (2020.08); *A63B 53/0408* (2020.08); *A63B 53/0454* (2020.08); *A63B 53/0462* (2020.08); *A63B 60/54* (2015.10); *A63B 2209/00* (2013.01); *A63B 2209/02* (2013.01)

(58) Field of Classification Search
CPC . A63B 53/04; A63B 53/0416; A63B 53/0458; A63B 53/047
USPC ..... 473/324–350
See application file for complete search history.

(56) References Cited

U.S. PATENT DOCUMENTS 4,523,759 A * 6/1985 Igarashi ..... A63B 53/04 73/11.01
5,348,302 A * 9/1994 Sasamoto ..... A63B 53/047 273/DIG. 23

(Continued)

FOREIGN PATENT DOCUMENTS

JP 08243195 A * 9/1996 ..... A63B 53/04
JP 08243195 A 9/1996

(Continued)

*Primary Examiner* — Alvin A Hunter
(74) *Attorney, Agent, or Firm* — Klarquist Sparkman, LLP

(57) ABSTRACT

Iron-type golf club heads are disclosed having a heel portion, a sole portion, a toe portion, a top-line portion, a front portion, a rear portion, and a striking face. The iron-type golf club heads include a localized stiffened region that is located on the striking face of the club head such that the localized stiffened region alters the launch conditions of golf balls struck by the club head in a way that wholly or partially compensates for, overcomes, or prevents the occurrence of a rightward deviation. In particular, the localized stiffened region is located on the striking face such that a golf ball struck under typical conditions will not impart a right-tending sidespin to the golf ball.

24 Claims, 7 Drawing Sheets

Related U.S. Application Data continuation of application No. 13/336,823, filed on Dec. 23, 2011, now Pat. No. 9,597,562.

(56) References Cited

U.S. PATENT DOCUMENTS 5,540,437 A * 7/1996 Bamber ..... A63B 53/04 473/343
5,564,705 A * 10/1996 Kobayashi ..... A63B 60/00 473/349
5,669,824 A * 9/1997 Aizawa ..... A63B 60/00 473/291
5,766,092 A * 6/1998 Mimeur ..... A63B 60/00 473/332
6,030,295 A * 2/2000 Takeda ..... A63B 60/00 473/335
6,045,456 A * 4/2000 Best ..... A63B 60/00 473/332
6,280,348 B1 * 8/2001 Stites ..... A63B 53/04 473/349
6,319,150 B1 * 11/2001 Werner ..... A63B 60/00 473/324
6,743,114 B2 * 6/2004 Best ..... A63B 53/047 473/332
6,923,733 B2 * 8/2005 Chen ..... A63B 53/047 473/305
6,942,580 B2 * 9/2005 Hou ..... A63B 53/047 473/332
7,041,003 B2 5/2006 Bissonnette et al.
7,115,048 B2 * 10/2006 Kusumoto ..... A63B 53/047 473/345
7,140,975 B2 11/2006 Bissonnette et al.
7,153,222 B2 * 12/2006 Gilbert ..... A63B 53/047 473/290
7,186,188 B2 * 3/2007 Gilbert ..... A63B 60/54 473/332
7,223,179 B2 5/2007 Tsunoda
7,396,290 B2 * 7/2008 Gilbert ..... A63B 60/54 473/290
7,651,412 B2 1/2010 Meyer et al.
7,749,102 B2 7/2010 Nakamura
7,803,062 B2 * 9/2010 Gilbert ..... A63B 53/0475 473/331
7,967,700 B2 6/2011 Stites
7,988,564 B2 * 8/2011 Jertson ..... A63B 53/047 473/290
8,012,040 B2 * 9/2011 Takechi ..... A63B 53/04 473/349
8,038,544 B2 10/2011 Meyer et al.
8,088,025 B2 * 1/2012 Wahl ..... A63B 60/00 473/345
8,182,362 B2 * 5/2012 Kusumoto ..... A63B 60/02 473/324
8,317,635 B2 * 11/2012 Gilbert ..... A63B 53/0475 473/409
8,342,985 B2 * 1/2013 Hirano ..... A63B 53/047 473/331
8,353,785 B2 * 1/2013 Ines ..... A63B 60/00 473/342
8,512,164 B2 * 8/2013 Ines ..... B23P 15/00 473/342
8,517,863 B2 * 8/2013 Wahl ..... B23P 17/04 473/346
8,535,176 B2 * 9/2013 Bazzel ..... A63B 53/047 473/290
9,597,562 B2 * 3/2017 Dipert ..... A63B 60/00
9,975,018 B2 * 5/2018 Dipert ..... A63B 53/047
10,245,484 B2 * 4/2019 Dipert ..... A63B 60/00
10,646,757 B2 * 5/2020 Dipert ..... A63B 60/00
11,305,165 B2 * 4/2022 Dipert ..... A63B 53/0475
2003/0153397 A1 * 8/2003 Roach ..... A63B 60/00 473/290
2003/0203763 A1 * 10/2003 Best ..... A63B 60/00 473/290
2010/0261540 A1 * 10/2010 Roach ..... A63B 60/00 473/332
2010/0273570 A1 * 10/2010 Ines ..... A63B 53/047 473/349
2011/0118052 A1 5/2011 Rice et al.
2012/0100931 A1 * 4/2012 Wahl ..... A63B 53/0475 473/345
2020/0324180 A1 10/2020 Dipert et al.

FOREIGN PATENT DOCUMENTS

JP 08280853 A * 10/1996
JP 08280853 A 10/1996
JP 09239075 A * 9/1997 ..... A63B 53/0466
JP 2002035178 2/2002
JP 2002035178 A * 2/2002 ..... A63B 53/0466
JP 2004187710 A * 7/2004 ..... A63B 53/047
JP 2004187710 A 7/2004
JP 2007289639 A * 11/2007
JP 2007289639 A 11/2007

* cited by examiner

IRON TYPE GOLF CLUB HEAD

CROSS-REFERENCE TO RELATED APPLICATIONS

This application is a continuation of U.S. patent application Ser. No. 16/866,927, filed May 5, 2020, now U.S. Pat. No. 11,305,165, which is a continuation of U.S. patent application Ser. No. 16/273,831, filed Feb. 12, 2019, now U.S. Pat. No. 10,646,757, which is a continuation of U.S. patent application Ser. No. 15/956,412, filed Apr. 18, 2018, now U.S. Pat. No. 10,245,484, which is a continuation of U.S. patent application Ser. No. 15/427,921, filed Feb. 8, 2017, now U.S. Pat. No. 9,975,018, which is a continuation of U.S. patent application Ser. No. 13/336,823, filed Dec. 23, 2011, now U.S. Pat. No. 9,597,562, all of which applications are hereby incorporated by reference herein.

FIELD

The present disclosure relates to golf club heads. More specifically, the present disclosure relates to golf club heads for iron type golf clubs.

BACKGROUND

A golf set includes various types of clubs for use in different conditions or circumstances in which a ball is hit during a golf game. A set of clubs typically includes a "driver" for hitting the ball the longest distance on a course. A fairway "wood" can be used for hitting the ball shorter distances than the driver. A set of irons are used for hitting the ball within a range of distances typically shorter than the driver or woods. Every club has an ideal striking location or "sweet spot" that represents the best hitting zone on the face for maximizing the probability of the golfer achieving the best and most predictable shot using the particular club.

An iron has a flat face that normally contacts the ball whenever the ball is being hit with the iron. Irons have angled faces for achieving lofts ranging from about 18 degrees to about 64 degrees. The size of an iron's sweet spot is generally related to the size (i.e., surface area) of the iron's striking face, and iron sets are available with oversize club heads to provide a large sweet spot that is desirable to many golfers. Most golfers strive to make contact with the ball inside the sweet spot to achieve a desired ball speed, distance, and trajectory.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of mass or a moment of inertia. These designs also permit club designers to provide striking plates that have relatively large face areas that are unsupported by the main body of the golf club head.

SUMMARY OF THE DESCRIPTION

The present disclosure describes iron type golf club heads typically comprising a head body and a striking plate. The head body includes a heel portion, a toe portion, a topline portion, a sole portion, and a hosel configured to attach the club head to a shaft. In some embodiments, the head body defines a front opening configured to receive the striking plate at a front rim formed around a periphery of the front opening. In other embodiments, the striking plate is formed integrally (such as by casting) with the head body.

In some embodiments, the iron type golf club heads include a localized stiffened region that is located on the striking face of the golf club head. In some embodiments, the localized stiffened region has a size, shape, stiffness profile, location, position, and/or other properties that alter the launch conditions of golf balls struck by the club head. For example, in some embodiments, golf ball launch conditions are altered in a way that wholly or partially compensates for, overcomes, or prevents the occurrence of a rightward deviation of golf ball shots struck by the golf club head.

According to one aspect of an embodiment of the golf club heads described herein, the striking plate includes a supported region and an unsupported region, with an ideal golf ball striking location lying within the unsupported region. The unsupported region may be divided by an imaginary vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE} > SA_{HEEL} \tag{1}$$

In addition, the unsupported region of the striking plate satisfies the following second inequality:

$$[(\Sigma_{n=1}^{N} E_n t_n^3) \div N][(\Sigma_{m=1}^{M} E_m t_m^3) \div M] > C \tag{2}$$

wherein $E_n$ and $t_n$ are the effective Young's Modulus value and the thickness, respectively, for the $n^{th}$ cross-section of the toe portion of the unsupported region of the striking face, $E_m$ and $t_m$ are the effective Young's Modulus value and the thickness, respectively, for the $m^{th}$ cross-section of the heel portion of the unsupported region of the striking face, N and M have values determined by discretizing $SA_{TOE}$ and $SA_{HEEL}$, respectively, into 1 mm×1 mm sections, and C is a constant having a value of 1.1.

In one example, the golf club head according to the foregoing first aspect has a relative coefficient of restitution of at least about −0.030, such as at least about −0.025, or at least about −0.020.

In another example, the golf club head according to the foregoing first aspect satisfies the second inequality for C having a value of 1.15. In other examples, the golf club head according to the foregoing first aspect satisfies the second inequality for C having a value of 1.20. In still other examples, the golf club head according to the foregoing first aspect satisfies the second inequality for C having a value of 1.25.

According to a second aspect of an embodiment of the golf club heads described herein, the striking plate includes a supported region and an unsupported region, with an ideal golf ball striking location lying within the unsupported region. The unsupported region may be divided by an imaginary center vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE} > SA_{HEEL} \tag{1}$$

In addition, a hitting region is defined as lying within the unsupported region between an imaginary heel side vertical plane located 20 mm to the heel side of the imaginary center vertical plane, and an imaginary toe side vertical plane located 20 mm to the toe side of the imaginary center vertical plane. The hitting region of the striking plate satisfies the following second inequality:

$$[(\Sigma_{n=1}^{N}E_n t_n^3)\div N][(\Sigma_{m=1}^{M}E_m t_m^3)\div M]>D_{VW} \quad (2)$$

wherein $E_n$ and $t_n$ are the effective Young's Modulus value and the thickness, respectively, for the $n^{th}$ cross-section of the toe portion of the hitting region of the striking face, $E_m$ and $t_m$ are the effective Young's Modulus value and the thickness, respectively, for the $m^{th}$ cross-section of the heel portion of the hitting region of the striking face, N and M have values determined by discretizing $SA_{TOE\ HR}$ and $SA_{HEEL\ HR}$, respectively, into 1 mm×1 mm sections, and $D_{VW}$ is a constant having a value of 1.25.

In one example, the golf club head according to the foregoing second aspect has a relative coefficient of restitution of at least about −0.030, such as at least about −0.025, or at least about −0.020.

In another example, the golf club head according to the foregoing second aspect satisfies the second inequality for $D_{VW}$ having a value of 1.3. In other examples, the golf club head according to the foregoing second aspect satisfies the second inequality for $D_{VW}$ having a value of 1.4. In still other examples, the golf club head according to the foregoing second aspect satisfies the second inequality for $D_{VW}$ having a value of 1.5.

According to a third aspect of an embodiment of the golf club heads described herein, the striking plate includes a supported region and an unsupported region, with an ideal golf ball striking location lying within the unsupported region. The unsupported region may be divided by an imaginary center vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE}>SA_{HEEL} \quad (1)$$

In addition, a hitting region is defined as lying within the unsupported region within an imaginary circle having a radius of 20 mm and having a center located at the ideal striking location. The hitting region of the striking plate satisfies the following second inequality:

$$[(\Sigma_{n=1}^{N}E_n t_n^3)\div N][(\Sigma_{m=1}^{M}E_m t_m^3)\div M]>D_{CW} \quad (2)$$

wherein $E_n$ and $t_n$ are the effective Young's Modulus value and the thickness, respectively, for the $n^{th}$ cross-section of the toe portion of the hitting region of the striking face, $E_m$ and $t_m$ are the effective Young's Modulus value and the thickness, respectively, for the $m^{th}$ cross-section of the heel portion of the hitting region of the striking face, N and M have values determined by discretizing $SA_{TOE\ HR}$ and $SA_{HEEL\ HR}$, respectively, into 1 mm×1 mm sections, and $D_{CW}$ is a constant having a value of 1.4.

In one example, the golf club head according to the foregoing third aspect has a relative coefficient of restitution of at least about −0.030, such as at least about −0.025, or at least about −0.020.

In another example, the golf club head according to the foregoing third aspect satisfies the second inequality for $D_{CW}$ having a value of 1.5. In other examples, the golf club head according to the foregoing third aspect satisfies the second inequality for $D_{CW}$ having a value of 1.65. In still other examples, the golf club head according to the foregoing third aspect satisfies the second inequality for $D_{CW}$ having a value of 1.80.

According to a fourth aspect of an embodiment of the golf club heads described herein, the striking plate includes a supported region and an unsupported region, with an ideal golf ball striking location lying within the unsupported region. The unsupported region may be divided by an imaginary center vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE}>SA_{HEEL} \quad (1)$$

In addition, the unsupported region of the striking plate satisfies the following second inequality:

$$[(\Sigma_{n=1}^{N}E_n t_n^3\times f(x,y))\div N]\div[(\Sigma_{m=1}^{M}E_m t_m^3\times f(x,y))\div M]>F \quad (2)$$

wherein $E_n$ and $t_n$ are the effective Young's Modulus value and the thickness, respectively, for an nth cross-section of the toe portion of the unsupported region of the striking face, $E_m$ and $t_m$ are the effective Young's Modulus value and the thickness, respectively, for an mth cross-section of the heel portion of the unsupported region of the striking face, N and M have values determined by discretizing $SA_{TOE}$ and $SA_{HEEL}$, respectively, into 1 mm×1 mm sections, F is a constant having a value of 3.1; and $$f(x,y)=Ae^{-(a(x-x_0)^2+2b(x-x_0)(y-y_0)+c(x-x_0)^2)}$$

wherein a two-dimensional x-y plane is defined to be tangent to the striking face and has an origin at the ideal striking location, with the x axis being parallel to the ground plane and having positive values extending toward the toe side, and the y axis being perpendicular to the x axis and having positive values extending toward the topline, and x is the x-coordinate and y is the y-coordinate for the center of an $n^{th}$ or $m^{th}$ cross-section;

$$a=(\cos^2\theta\div 2\sigma_x^2)+(\sin^2\theta\div 2\sigma_y^2);$$

$$b=(\sin 2\theta\div 4\sigma_x^2)+(\sin 2\theta\div 4\sigma_y^2);$$

$$c=(\sin^2\theta\div 2\sigma_x^2)+(\cos^2\theta\div 2\sigma_y^2);$$

A=1;
$x_0$=7 mm;
$y_0$=22 mm;
$\sigma_x$=15 mm;
$\sigma_y$=20 mm; and
$\Theta$=30°.

In one example, the golf club head according to the foregoing fourth aspect has a relative coefficient of restitution of at least about −0.030, such as at least about −0.025, or at least about −0.020.

In another example, the golf club head according to the foregoing fourth aspect satisfies the second inequality for F having a value of 3.4. In other examples, the golf club head according to the foregoing fourth aspect satisfies the second inequality for F having a value of 4.0. In still other examples, the golf club head according to the foregoing fourth aspect satisfies the second inequality for F having a value of 4.4.

According to a fifth aspect of an embodiment of the golf club heads described herein, the striking plate includes a supported region and an unsupported region, with an ideal golf ball striking location lying within the unsupported region. The unsupported region may be divided by an imaginary vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE} > SA_{HEEL} \quad (1)$$

In addition, the clubhead has a negative Sidespin Performance Value as defined herein.

In one example, the golf club head according to the foregoing fifth aspect has a relative coefficient of restitution of at least about −0.030, such as at least about −0.025, or at least about −0.020.

According to a sixth aspect of an embodiment of the golf club heads described herein, the striking plate includes a supported region and an unsupported region, with an ideal golf ball striking location lying within the unsupported region. The unsupported region may be divided by an imaginary vertical plane passing through the ideal striking location to include a toe portion having a toe portion surface area ($SA_{TOE}$) and a heel portion having a heel portion surface area ($SA_{HEEL}$), with the respective surface areas satisfying the following first inequality:

$$SA_{TOE} > SA_{HEEL} \quad (1)$$

In addition, the unsupported region of the striking plate includes a localized stiffened region having a center of gravity located within the toe region such that the following second inequality is satisfied:

$$[(\Sigma_{n=1}^{N} E_n t_n^3) \div N][(\Sigma_{m=1}^{M} E_m t_m^3) \div M] > G \quad (2)$$

wherein $E_n$ and $t_n$ are the effective Young's Modulus value and the thickness, respectively, for the $n^{th}$ cross-section of the localized stiffened region of the striking face, $E_m$ and $t_m$ are the effective Young's Modulus value and the thickness, respectively, for the $m^{th}$ cross-section of the unsupported region of the striking face, N and M have values determined by discretizing $SA_{LSR}$ and $SA_{UR}$, respectively, into 1 mm×1 mm sections where $SA_{LSR}$ is the surface area of the localized stiffened region and $SA_{UR}$ is the surface area of the entire unsupported region, and G is a constant having a value of at least 1.6.

In one example, the golf club head according to the foregoing sixth aspect has a relative coefficient of restitution of at least about −0.030, such as at least about −0.025, or at least about −0.020.

In another example, the golf club head according to the foregoing sixth aspect satisfies the second inequality for G having a value of 1.75. In other examples, the golf club head according to the foregoing sixth aspect satisfies the second inequality for G having a value of 2.25. In still other examples, the golf club head according to the foregoing sixth aspect satisfies the second inequality for G having a value of 3.0.

The foregoing and other features and advantages of the golf club heads described herein will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

1. Iron Type Golf Club Heads

Figure 1A:
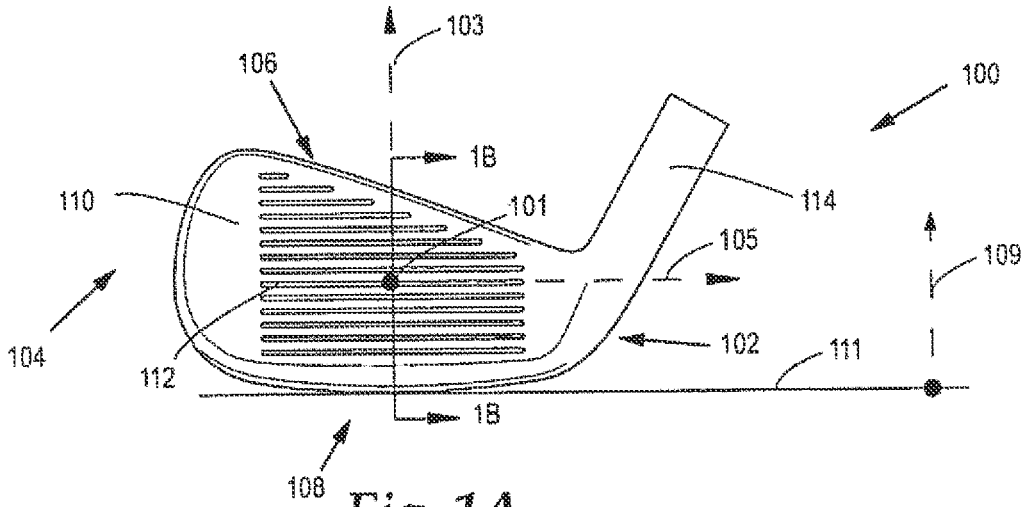
FIG. 1A is a front view of an embodiment of a golf club head.

FIG. 1A illustrates an iron type golf club head 100 including a body 113 having a heel 102, a toe 104, a sole portion 108, a top line portion 106, and a hosel 114. The golf club head 100 is shown in FIG. 1A in a normal address position with the sole portion 108 resting upon a ground plane 111, which is assumed to be perfectly flat. As used herein, "normal address position" means the club head position wherein a vector normal to the center of the club face substantially lies in a first vertical plane (i.e., a vertical plane is perpendicular to the ground plane 111), a centerline axis of the hosel 114 substantially lies in a second vertical plane, and the first vertical plane and the second vertical plane substantially perpendicularly intersect. The center of the club face is determined using the procedures described in the USGA "Procedure for Measuring the Flexibility of a Golf Clubhead," Revision 2.0, Mar. 25, 2005.

The striking face 110 defines a face plane 125 and includes grooves 112 that are designed for impact with the golf ball. In some embodiments, the golf club head 100 can be a single unitary cast piece, while in other embodiments, a striking plate can be formed separately to be adhesively or mechanically attached to the body 113 of the golf club head 100.

Figure 1B:
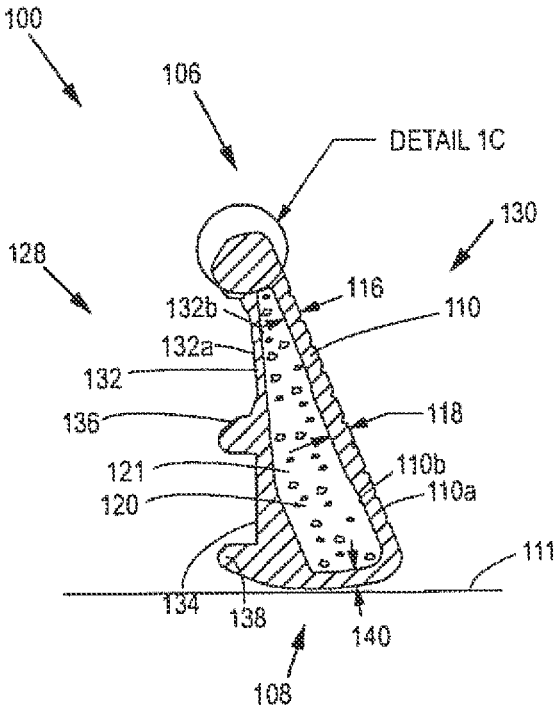
FIG. 1B is a cross-sectional view taken along section lines 1B-1B in FIG. 1A.
Figure 1C:
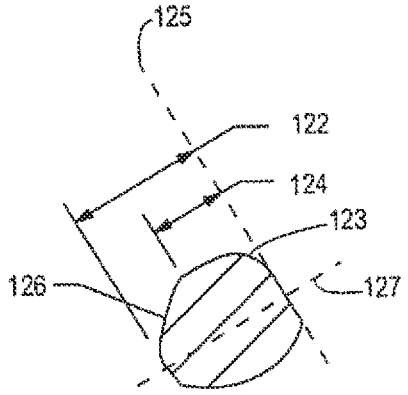
FIG. 1C is a magnified view of DETAIL 1C in FIG. 1B.
Figure 1D:
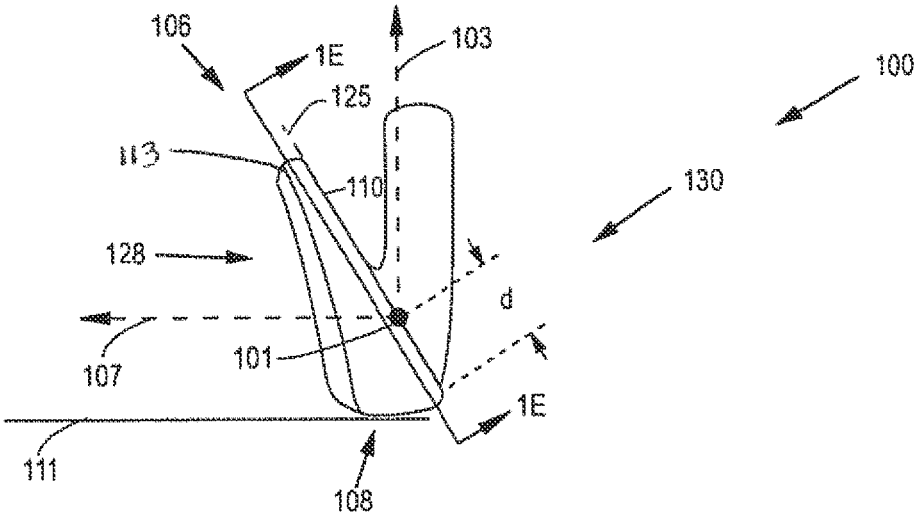
FIG. 1D is an elevated toe perspective view of a golf club head.

FIGS. 1A and 1D also show an ideal striking location 101 on the striking face 110 and respective orthogonal CG axes. As used herein, the ideal striking location 101 is located within the face plane 125 and coincides with the location of the center of gravity (CG) of the golf club head along the CG x-axis 105 (i.e., CG-x) and is offset from the leading edge (defined as the intersection of the sole portion 108 and the face plane 125) by a distance d of about 16.5 mm within the face plane 125, as shown in FIG. 1D. A CG x-axis 105, CG y-axis 107, and CG z-axis 103 intersect at the ideal striking location 101, which defines the origin of the orthogonal CG axes. With the golf club head 100 in the normal address position, the CG x-axis 105 is parallel to the ground plane 111 and is oriented perpendicular to a normal extending from the striking face 110 at the ideal striking location 101. The CG y-axis is also parallel to the ground plane and is perpendicular to the CG x-axis. The CG z-axis 103 is oriented perpendicular to the ground plane. In addition, a CG z-up axis 109 is defined as an axis perpendicular to the ground plane 111 and having an origin at the ground plane 111.

In certain embodiments, a desirable CG-y location is between about 0.25 mm to about 20 mm along the CG y-axis 107 toward the rear portion of the club head. Additionally, a desirable CG-z location is between about 12 mm to about 25 mm along the CG z-up axis 109, as previously described.

The golf club head may be of hollow, cavity back, or other construction. FIG. 1B shows a cross sectional side view along the cross-section lines 1B-1B shown in FIG. 1A of an embodiment of the golf club head having a hollow construction. The cross-section lines 1B-1B are taken through the ideal striking location 101 on the striking face 110. The striking face 110 includes a front surface 110*a* and a rear surface 110*b*. The hollow iron golf club head 100 embodiment further includes a back portion 128 and a front portion 130.

In the embodiment shown in FIGS. 1A-1E, the grooves 112 are located on the striking face 110 such that they are centered along the CG x-axis about the ideal striking location 101, i.e., such that the ideal striking location 101 is located within the striking face plane 125 on an imaginary line that is both perpendicular to and that passes through the midpoint of the longest score-line groove 112. In other embodiments (not shown in the drawings), the grooves 112 may be shifted along the CG x-axis to the toe side or the heel side relative to the ideal striking location 101, the grooves 112 may be aligned along an axis that is not parallel to the ground plane 111, the grooves 112 may have discontinuities along their lengths, or the grooves may not be present at all. Still other shapes, alignments, and/or orientations of grooves 112 on the surface of the striking face 110 are also possible.

FIG. 1B further shows an optional ridge 136 extending across a portion of the outer back wall surface 132*a* forming an upper concavity and a lower concavity. An inner back wall surface 132*b* defines a portion of the cavity 120 and forms a thickness between the outer back wall surface 132*a* and the inner back wall surface 132*b*. In some embodiments, the back wall thickness varies between a thickness of about 1 mm to about 3 mm. Furthermore, the sole portion 108 has a sole thickness dimension 140 that extends within a region between a rear protrusion 138 and the striking face 110. In certain embodiments, the sole thickness dimension 140 is between about 1 mm and about 2 mm, or less than about 2 mm. In one embodiment, a preferred sole thickness 140 is about 1.7 mm or less.

FIG. 1C is a magnified view of the top line 106 DETAIL 1C of the golf club embodiment shown in FIG. 1B. FIG. 1C shows the top line 106 and a striking plane 125 that is parallel to and contains the front striking surface 110. A second plane 127 is shown being perpendicular to the striking plane 125 and the striking surface 110. The top line 106 includes a return surface 123 immediately adjacent to the striking face 110 in the top line portion 106. The return surface 123 extends from the striking face 110 toward the back portion 128 and a majority of the return surface 123 is generally parallel with the second plane 127. A transition surface 126 connects the return surface 123 to the outer back wall surface 132*a*.

In certain embodiments, the return surface 123 extends from the striking face 110 a return distance 124 (or "effective top line thickness") of between about 3.5 mm and 5 mm, or about 4.8 mm or less, as measured along the second plane 127 and perpendicular to the striking plane 125. In some embodiments, the return surface 123 extends less than 60% of the total top line thickness 122. In certain embodiments, the total top line thickness 122 is between about 6 mm and about 9 mm, or about 8.5 mm or less, as measured along the second plane 127 and perpendicular to the striking plane 125.

A small effective top line thickness 124 of the return surface 123 creates the perception to a golfer that the entire top line 106 of the club head 100 is thin. A perceived thin top line 106 can enhance the aesthetic appeal to a golf player.

FIG. 1D illustrates an elevated toe view of the golf club head 100 including a back portion 128, a front portion 130, a sole portion 108, a top line portion 106, and a striking face 110, as previously described.

In certain embodiments of iron type golf club heads having hollow construction, a recess 134 is located above the rear protrusion 138 in the back portion 128 of the club head. A back wall 132 encloses the entire back portion 128 of the club head to define a cavity 120 that is optionally filled with a filler material 121. Suitable filler materials are described in US Patent Application Publication No. 2011/0028240, which is incorporated herein by reference.

Figure 2A:
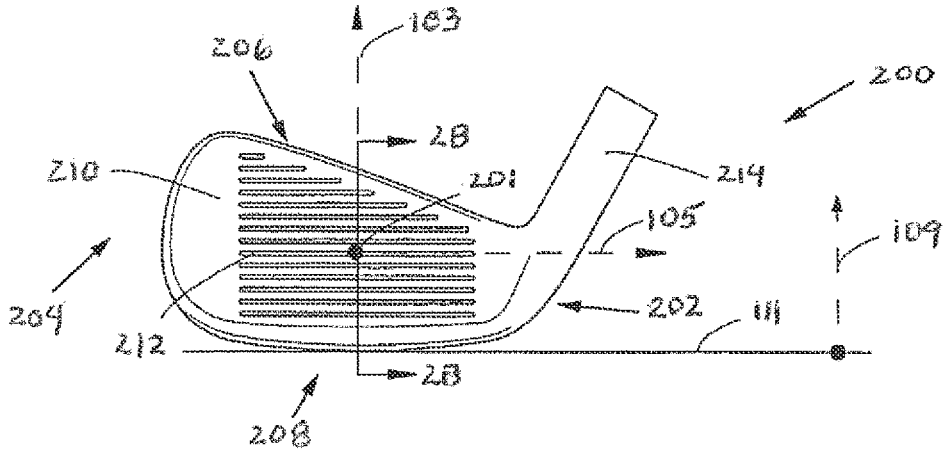
FIG. 2A is a front view of another embodiment of a golf club head.

Turning next to FIGS. 2A-D, an embodiment of a golf club head 200 having a cavity back construction is shown. Like the hollow construction golf club 100, the cavity back golf club head 200 includes a body 213 having a heel 202, a toe 204, a sole portion 208, a top line portion 206, and a hosel 214. The golf club head 200 is shown in FIG. 2A in a normal address position with the sole portion 208 resting upon a ground plane 111, which is assumed to be perfectly flat. The striking face 210 defines a face plane 225 and includes grooves 212 that are designed for impact with the golf ball. In some embodiments, the golf club head 200 can be a single unitary cast piece, while in other embodiments, a striking plate can be formed separately to be adhesively or mechanically attached to the body 213 of the golf club head 200.

Figure 2B:
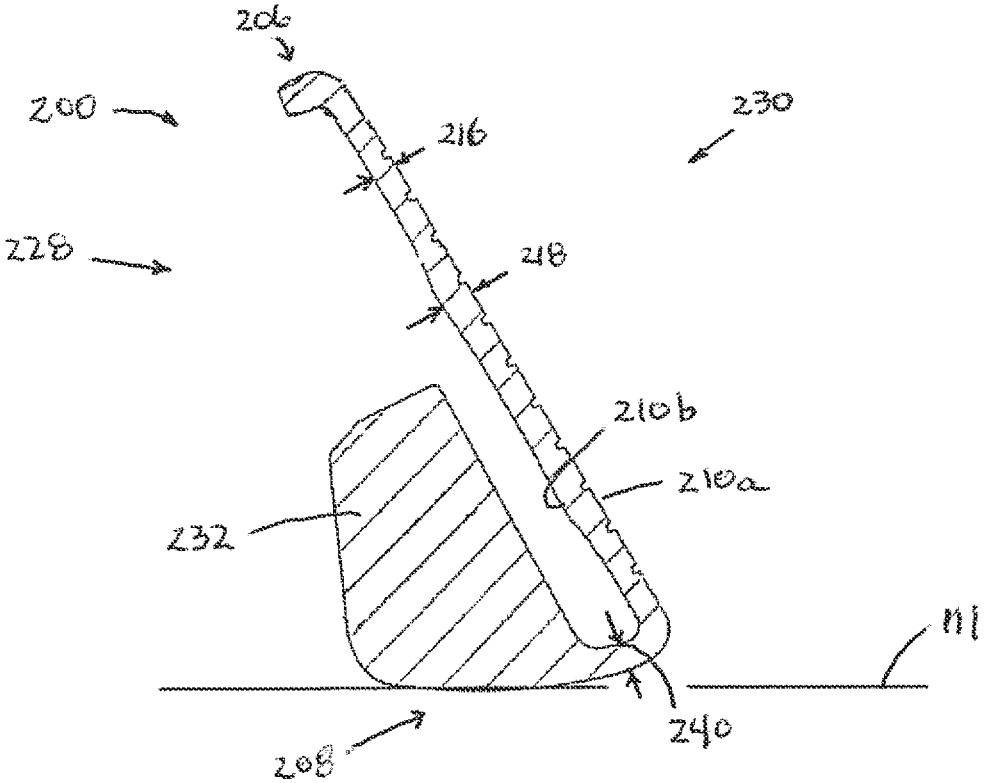
FIG. 2B is a cross-sectional view taken along section lines 2B-2B in FIG. 2A.
Figure 2C:
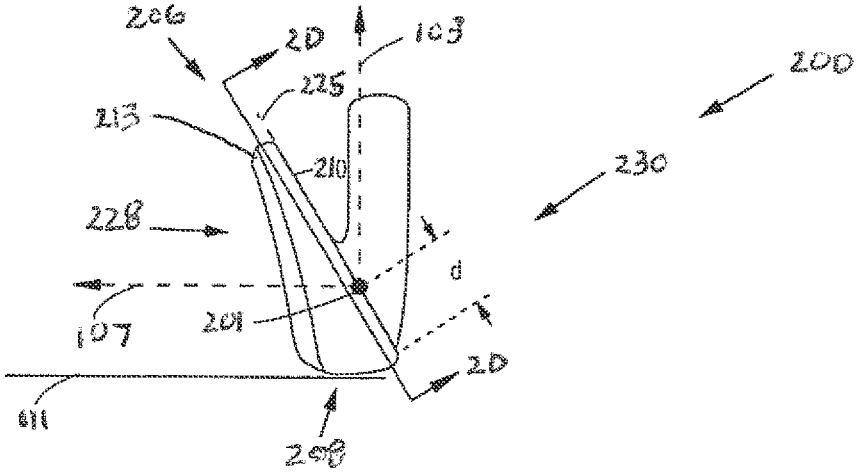
FIG. 2C is an elevated toe perspective view of a golf club head.

FIGS. 2A and 2C also show an ideal striking location 201 on the striking face 210 and respective orthogonal CG axes (CG x-axis 105, CG y-axis 107, and CG z-axis 103) as described previously. The ideal striking location 201 in the cavity back golf club head 200 is located within the face plane 225 at the same location relative to the CG x-axis and the leading edge as the ideal striking location 101 of the hollow golf club head 100, described above. In certain embodiments of the cavity back golf club head 200, a desirable CG-y location is between about 0.25 mm to about 20 mm along the CG y-axis 107 toward the rear portion of the club head. Additionally, a desirable CG-z location is between about 12 mm to about 25 mm along the CG z-up axis 109, as previously described.

Figure 1E:
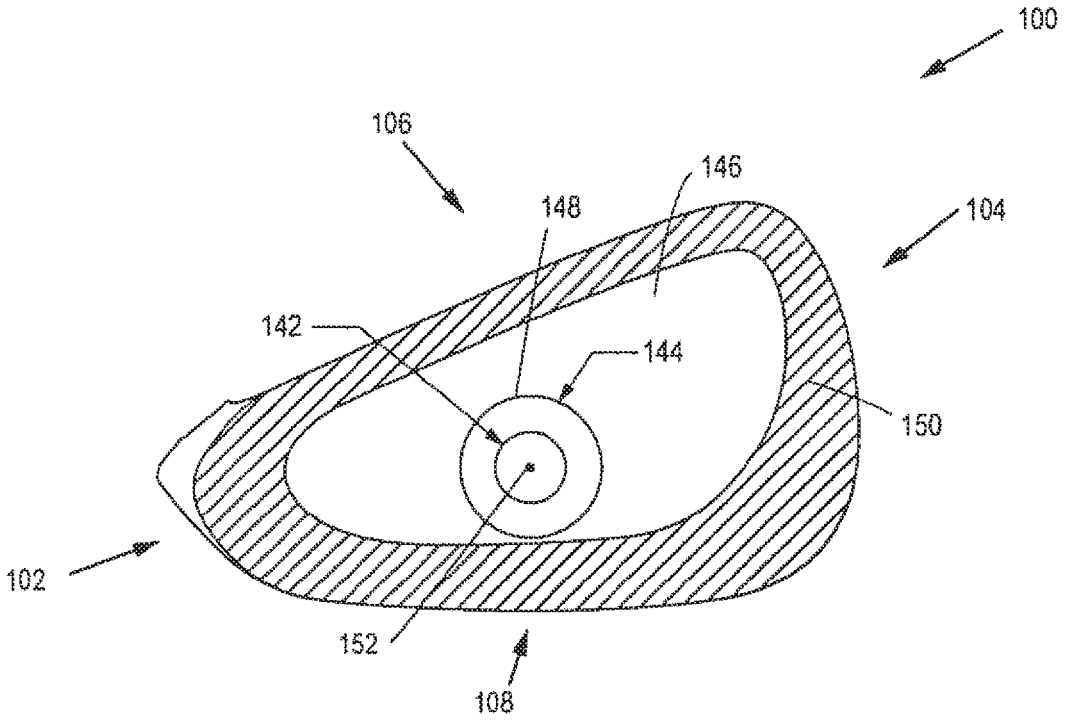
FIG. 1E is a cross-sectional view taken along section lines 1E-1E in FIG. 1D.

FIG. 2B shows a cross sectional side view along the cross-section lines 2B-2B shown in FIG. 2A. The cross-section lines 2B-2B are taken through the ideal striking location 201 on the striking face 210. The striking face 210 includes a front surface 210*a* and a rear surface 210*b*. The cavity back iron golf club head 200 embodiment further includes a back portion 228 and a front portion 230. In the embodiment shown in FIGS. 2A-2D, the grooves 212 are located on the striking face 210 having the same shape and orientation as with the golf club head 100 described above in relation to FIGS. 1A-E. As with the previous embodiment, still other shapes, alignments, and/or orientations of grooves 212 on the surface of the striking face 210 are also possible.

FIG. 2B further shows a back wall 232 of the cavity back golf club head 200. The back wall 232 has a relatively large thickness in relation to the striking plate and other portions of the golf club head 200, thereby accounting for a significant portion of the mass of the golf club head 200, and thereby shifting the center of gravity (CG) of the golf club head 200 relatively lower and rearward. Furthermore, the sole portion 208 has a sole thickness dimension 240 that extends within a region between the back wall 232 and the striking face 210. In certain embodiments, the sole thickness dimension 240 is between about 1 mm and about 2 mm, or less than about 2 mm. In one embodiment, a preferred sole thickness 240 is about 1.7 mm or less.

In certain embodiments of the golf club heads 100, 200 that include a separate striking plate attached to the body 113, 213 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113, 213 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113, 213 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 113, 213 of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

After forming the striking plate and the body 113, 213 of the golf club head, the striking plate and body portion 113, 213 contact surfaces can be finish-machined to ensure a good interface contact surface is provided prior to welding. In some embodiments, the contact surfaces are planar for ease of finish machining and engagement.

Figure 3A:
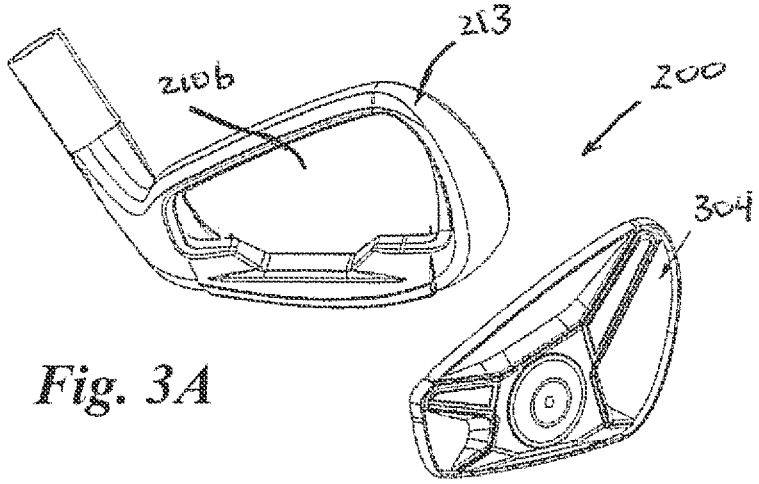
FIG. 3A is an isometric view of a golf club head assembly.

FIG. 3A illustrates a cavity back golf club head 200 including a club head body 213 and a badge 304 (or third piece). The badge 304 is adhesively bonded to the rear surface 210*b* of the striking face of the club head 200. The badge 304 obscures any weld beads, deformations, markings, or other visible items on the rear surface 210*b* of the striking face so that no visual difference can be observed by the user. For example, applying the badge 304 allows a weld to be placed on the face of the iron with minimal cost. Furthermore, the badge 304 can have desirable effects on sound and vibration dampening upon impact with a golf ball.

Figure 3B:
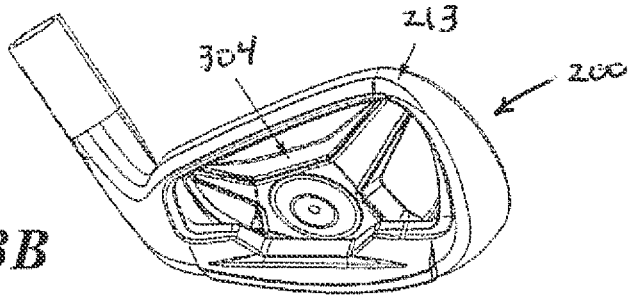
FIG. 3B is an isometric view of an assembled golf club head.

FIG. 3B illustrates an assembled view of the golf club head 200 where the badge 304 has been adhesively applied with epoxy or any known adhesive. For example, an epoxy such as 3M™ DP460 can be used. It is possible for the badge 304 to be mechanically attached to the club head portion 213.

2. Features of Iron Type Golf Club Heads

Several specific features of iron type golf club heads are described below, in reference to the perimeter weighted golf club heads described in the preceding sections.

A. Unsupported Face Area

Conventional perimeter weighted iron type golf club heads (e.g., hollow and cavity back designs) include a perimeter annular mass in the rear portion of the club head that wholly or partially surrounds the hollow back or cavity back formed in the center of the golf club head. As a result, the striking face of such club heads is made up of a supported region located in front of the perimeter annular mass, and an unsupported region located in front of the hollow back or cavity. In some designs, a backing member such as a badge or other member may be attached to the rear side of the unsupported region.

A point on the face of a club head can be considered beam-like in cross-section and its bending stiffness at a given location on the face can be calculated as a product of the Young's Modulus (E) of the material making up the face at the point and the cube of the face thickness, $t^3$, at the point. That is, the bending stiffness at a point on the face of a club head is a function of $Et^3$ at that point. Thus, the bending stiffness of a conventional perimeter weighted iron type golf club head having a striking face made of a homogeneous material will vary significantly between the supported region (where cross-sectional thickness, t, is relatively greater) and the unsupported region (where cross-sectional thickness, t, is relatively less).

Figure 2D:
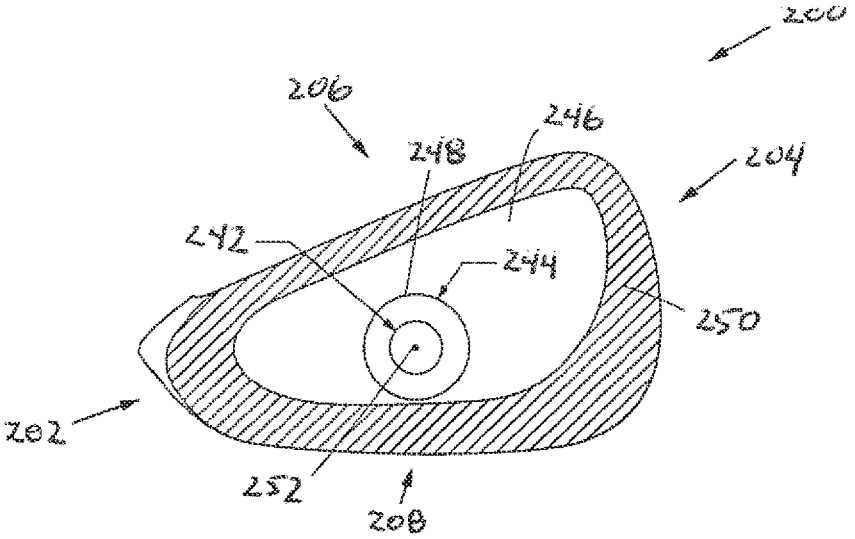
FIG. 2D is a cross-sectional view taken along section lines 2D-2D in FIG. 2C.

FIG. 1E illustrates a cross-sectional view taken along cross-sectional lines 1E-1E of FIG. 1D. FIG. 2D shows a similar cross-sectional view taken along cross-sectional lines 2D-2D of FIG. 2C. FIGS. 1E and 2D show rear unsupported face regions 146 and 246, inverted cone technology regions 148 and 248 (hereinafter, "ICT region" or "Thickened Central Region"), and rear supported face regions 150 and 250. The unsupported face region 146, 246 is a region of the striking face 110, 210 where the cross-sectional bending stiffness of the face is low relative to the cross-sectional bending stiffness of the supported region 150, 250. For example, the unsupported face region 146, 246 may be the area of the striking face 110, 210 where the thickness of the face is thin (i.e. less than about 3 mm or less than about 5 mm) and is not supported by any separate or integrated metallic structure having a significant impact on the stiffness of the striking face 110, 210.

The rear supported face region 150, 250 is located about a periphery of the unsupported face region 146, 246. The rear supported face region 150, 250 includes the areas of the striking face 110, 210 that are supported by the separate or integrated metallic structure making up the body portion 113, 213 of the golf club head.

B. Flexible Striking Face

The striking plate of the golf club heads described herein include construction and materials that produce relatively high coefficients of restitution (COR) and characteristic times (CT) (as these terms are defined herein), while maintaining sufficient durability for a commercially acceptable golf club head. For example, in some embodiments, the striking plate of the club head is constructed having a relatively thin cross-section in order to increase the flexibility of the striking plate, thereby increasing both CT and COR. In other embodiments, the striking plate of the golf club head comprises a material or materials having a relatively low Young's Modulus (E) value, also in order to increase the flexibility of the striking plate. Combinations of these design factors are also possible in order to obtain a striking plate having a relatively high amount of flexibility, thereby increasing the efficiency of clubface to golf ball impact, increasing COR, and/or increasing CT.

In some embodiments, the striking face 110, 210 of the golf club head has a uniform thickness of between about 1.5 mm to about 3.0 mm, such as between about 1.7 mm to about 2.5 mm, or between about 1.8 mm to about 2.0 mm. In these embodiments, the striking face 110, 210 comprises steel, titanium, polymer-fiber composite, or one or more of the materials described above.

In the embodiments shown in FIGS. 1A-E and 2A-D, the golf club heads 100, 200 each include a striking face 110, 210 having a first thickness 116, 216 located generally in a peripheral region of the striking face 110, 210 and a second thickness 118, 218 located generally in a central region of the striking face 110, 210. The second thickness 118, 218 is greater than the first thickness 116, 216. In certain embodiments, the first thickness 116, 216 can be between about 1.5 mm and about 3.0 mm, with a preferred thickness of about 2 mm or less. The second thickness 118, 218 can be between about 1.7 mm and about 3.5 mm, with a preferred thickness of about 3.1 mm or less. Furthermore, as described above, the sole portion 108, 208 has a sole thickness dimension 140, 240 that is between about 1 mm and about 2 mm, or less than about 2 mm. In some embodiments, a preferred sole thickness 140, 240 is about 1.7 mm or less.

The thickness profiles and low thickness values of the striking face 110 can be achieved during the forging of the striking face 110. In one embodiment, a 0.3 mm to 1.0 mm machine stock plate can be added to the striking face 110 to increase tolerance control. After forging, the striking face 110 can be slightly milled and engraved with score-lines. A key advantage of being able to forge such a thin face is the freeing up of discretionary mass (up to about 20 g) that can be placed elsewhere in the club head (such as the rear piece) for manipulation of the moment of inertia or center of gravity location.

The thickness of the striking face 110 in the thin face area is generally consistent in thickness and non-variable. Of course, manufacturing tolerances may cause some variation in the thin face area. In certain embodiments, the thin face area is about 50% or more of the unsupported face region 146, 246.

C. Localized Stiffened Regions

In several embodiments, the striking plate of the golf club head 100, 200 includes a localized stiffened region that is located on the striking face 110, 210 at a location that surrounds or that is adjacent to the ideal striking location 101, 201. The localized stiffened region comprises an area of the striking face 110, 210 that has increased stiffness due to being relatively thicker than a surrounding region, due to being constructed of a material having a higher Young's Modulus (E) value than a surrounding region, and/or a combination of these factors. Localized stiffened regions may be included on a striking face 110, 210 for one or more reasons, such as to increase the durability of the club head striking face, to increase the area of the striking face that produces high COR, or a combination of these reasons.

Several examples of localized stiffened regions are the variable thickness configurations or inverted cone technology regions such as those discussed in, for example, U.S. Pat. Nos. 6,800,038, 6,824,475, 6,904,663, and 6,997,820, all incorporated herein by reference. For example, as noted above, FIG. 1E illustrates a cross-sectional view taken along cross-sectional lines 1E-1E of FIG. 1D, and FIG. 2D shows a cross-sectional view taken along cross-sectional lines 2D-2D of FIG. 2C. FIG. 1E and FIG. 2D each show a rear view of an unsupported face region 146, 246 having an inverted cone technology region 148, 248 and a rear view of a supported face region 150, 250.

The inverted cone regions 148, 248 each comprise symmetrical "donut" shaped areas of increased thickness that are located within the unsupported face region 146, 246. In the embodiments shown in FIGS. 1E and 2D, the inverted cone regions 148, 248 are centered on the ideal striking location 101, 201. The inverted cone region 148, 248 includes an outer span 144, 244 and an inner span 142, 242 that are substantially concentric about a center 152, 252. In some embodiments, the outer span 144, 244 has a diameter of between about 15 mm and about 25 mm, or at least about 20 mm. In other embodiments, the outer span 144, 244 has a diameter greater than about 25 mm, such as about 25-35 mm, about 35-45 mm, or more than about 45 mm. The inner span 142, 242 of the inverted cone region 148, 248 represents the thickest portion of the unsupported face region 146, 246. In certain embodiments, the inner diameter 142, 242 is between about 5 mm and about 15 mm, or at least about 10 mm.

In other embodiments, the localized stiffened region comprises a stiffened region (e.g., a localized region having increased thickness in relation to its surrounding regions) having a shape and size other than those described above for the inverted cone regions 148, 248. The shape may be geometric (e.g., triangular, square, trapezoidal, etc.) or irregular. For these embodiments, a center of gravity of the localized stiffened region ($CG_{LSR}$) may be determined by defining a boundary for the localized stiffened region and calculating or otherwise determining the center of gravity of the defined region. An area, volume, and other measurements of the localized stiffened region are also suitable for measurement upon defining the appropriate boundary.

3. Performance of Previous High-COR Iron Type Golf Clubs

As used herein, the terms "coefficient of restitution," "COR," "relative coefficient of restitution," "relative COR," "characteristic time," and "CT" are defined according to the following. The coefficient of restitution (COR) of an iron clubhead is measured according to procedures described by the USGA Rules of Golf as specified in the "Interim Procedure for Measuring the Coefficient of Restitution of an Iron Clubhead Relative to a Baseline Plate," Revision 1.2, Nov. 30, 2005 (hereinafter "the USGA COR Procedure"). Specifically, a COR value for a baseline calibration plate is first determined, then a COR value for an iron clubhead is determined using golf balls from the same dozen(s) used in the baseline plate calibration. The measured calibration plate COR value is then subtracted from the measured iron clubhead COR to obtain the "relative COR" of the iron clubhead.

To illustrate by way of an example: following the USGA COR Procedure, a given set of golf balls may produce a measured COR value for a baseline calibration plate of 0.845. Using the same set of golf balls, an iron clubhead may produce a measured COR value of 0.825. In this example, the relative COR for the iron clubhead is 0.825−0.845=−0.020. This iron clubhead has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards.

Most commercially available iron type golf clubs have relative COR values that are lower than about −0.045. One exception has been the Burner® and Burner® 2.0 irons produced and sold by the TaylorMade Golf Company. The Burner® and Burner® 2.0 irons have relative COR values of up to about −0.020 for the longer irons included in the set. The high relative COR values for the Burner® and Burner® 2.0 irons are provided by, among other features, the thin, flexible striking plate and large unsupported face area included on these golf clubs.

Testing has shown that the flexible striking plate and large unsupported face area of the Burner® and Burner® 2.0 irons produce launch conditions that result in a rightward deviation for (right-handed) centerface golf shots hit using these clubs. For example, under certain test conditions, a golf ball struck at centerface using a Burner® 2.0 4 iron will have a rightward deviation of up to about 7 yards.

The present inventors investigated the performance of the high-COR Burner® and Burner® 2.0 irons and other high-COR club head designs and determined that the rightward tendency was caused primarily by the occurrence of a sidespin component of the spin imparted to the golf ball upon launch off the face of the clubhead. For example, iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, a model of a Burner® 2.0 4 iron was observed to produce sidespin of about 158.23 rpm under a conventional set of launch conditions (ball speed of 133.43 fps, launch angle 16.22°, backspin of 4750 rpm), which contributed to a rightward deviation of about 6.76 yards over a shot distance (carry only) of about 207.58 yards. This performance and, in particular, the degree of rightward deviation for golf ball shots made using the longer irons included in the Burner® 2.0 iron set, has been confirmed via robot and player testing.

Figure 4:
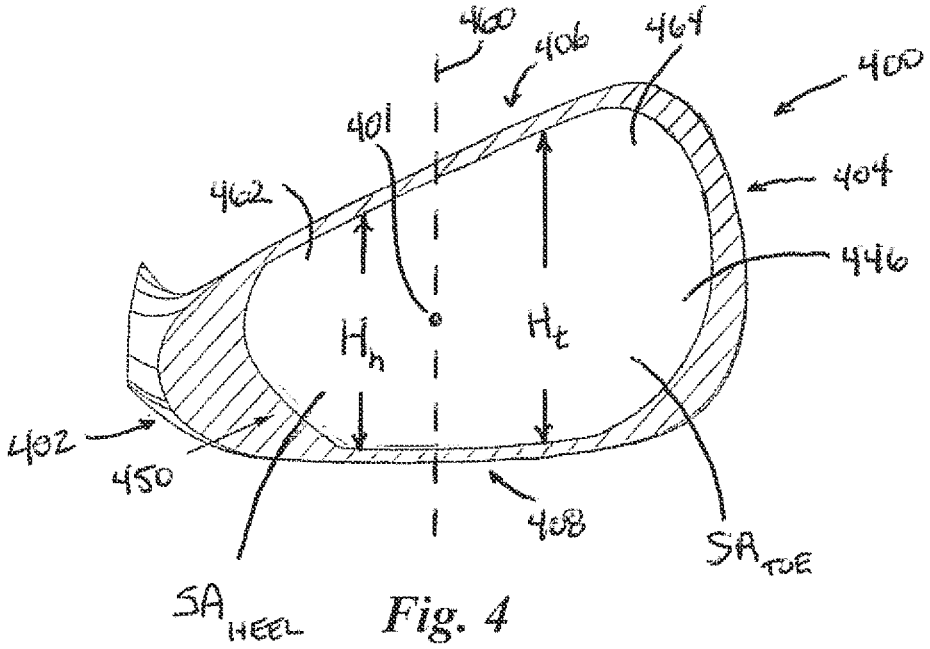
FIG. 4 is a rear cross-sectional view of a golf club head according to an embodiment.

Further investigation of the cause of the rightward tendency of the high-COR Burner® and Burner® 2.0 irons showed that the sidespin imparted to the golf ball was caused primarily by the asymmetric deformation of the unsupported region of the striking face upon impact with the golf ball. Unlike a conventional driver, wood, or metalwood type clubhead, the unsupported region of the face of a conventional iron clubhead is asymmetric in shape, having a heel region with a relatively short face height and a toe region with a relatively large face height. For example, FIG. 4 shows a rear cross-sectional view of a cavity back golf club head 400 having a heel 402, a toe 404, a sole portion 408, and a top line portion 406. An ideal striking location 401 is located within the unsupported face region 446, which is surrounded by the supported face region 450. An imaginary centerface line 460 is drawn perpendicular to the ground plane 111 and passing through the ideal striking location 401, thereby separating the unsupported face region 446 into a heel unsupported face region 462 and a toe unsupported face region 464.

As shown in FIG. 4, the heel unsupported face region 462 has a height $H_h$ at a given location within the region, and the toe unsupported face region 464 has a height $H_t$ at a given location within the region. In addition, the heel unsupported face region 462 has a surface area $SA_{HEEL}$ and the toe unsupported face region 464 has a surface area $SA_{TOE}$. Because a conventional iron type club head includes a top line 406 that diverges upward (i.e., away from) the sole region 408 as the top line 406 extends from the heel 402 to the toe 404, the height $H_t$ at a given location with the toe region will be greater than the height $H_h$ at a given location within the heel region. Also, the surface area of the toe unsupported face region $SA_{TOE}$ will be greater than the surface area of the heel unsupported face region $SA_{HEEL}$, i.e., $SA_{TOE}>SA_{HEEL}$.

For a striking plate of a given thickness or stiffness, the broader area of the toe unsupported face region 464 relative to that of the heel unsupported face region 462 will allow the striking plate to deform more in the toe region than it does in the heel region under a given load. As a result, a given amount of force applied to the unsupported region of the face of a conventional iron club head will create an increased amount of deformation of the striking plate when the force is applied toward the toe region 464 of the striking plate relative to the same force applied toward the heel region 462 of the striking plate. In the case of a golf ball impacting a clubface at typical clubhead speeds encountered during normal use, the golf ball impact area on the striking face can be sufficiently large that the deformation area itself can be asymmetric when the striking plate stiffness is sufficiently low and the unsupported face area 446 is sufficiently asymmetric (i.e., $H_t>H_r$ and/or $SA_{TOE}>SA_{HEEL}$). When the deformation area is asymmetric, the launch conditions of the struck golf ball will include a significant sidespin component and the golf ball will have a significant rightward deviation (for a right handed shot).

4. Descriptions of Inventive High-COR Iron Type Golf Clubs

The high-COR iron type club heads described herein include a localized stiffened region that is located on the striking face of the club head such that the localized stiffened region alters the launch conditions of golf balls struck by the club head in a way that wholly or partially compensates for, overcomes, or prevents the occurrence of the foregoing rightward deviation. In particular, the localized stiffened region is located on the striking face such that a golf ball struck under typical conditions will not impart a right-tending sidespin to the golf ball.

The inventors of the club heads described herein investigated the effect of modifying the stiffness of particular regions of the striking face of high-COR iron type club heads. Iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, models of high-COR club heads having localized stiffened regions at several locations in the unsupported face region of the club heads were observed to produce reduced or no right-tending sidespin and reduced or no rightward deviation for right handed golf shots. In some cases, the inventive club heads produced a left-tending sidespin and leftward deviation for right handed golf shots.

For example, Table 1 below shows simulation data for several club head designs that include an inverted cone technology region 148, 248 located at various locations on the striking face of the club head. With the exceptions listed below, the ICT Region 148, 248 for each of the club heads described in Table 1 included an inner diameter of about 11 mm and an outer diameter of about 22 mm. The exceptions are the entries identified as Rev. G, which included an inner diameter of 17 mm and an outer diameter of 28 mm, and Rev. J, which included an inner diameter of 23 mm and an outer diameter of 34 mm. In addition, Rev. L included a transition region having a diameter of about 45 mm, and Rev. M included a non-symmetric transition region.

TABLE 1

| ID | ICT Peak (mm) | ICT x-loc (mm) | ICT y-loc (mm) | Toe/Heel thk (mm) | Top thk (mm) | Bottom thk (mm) | Deviation (yds) | Relative COR |
|---|---|---|---|---|---|---|---|---|
| B 2.0 | 2.6 | 0.0 | 18.0 | 1.8 | 1.9 | 2.1 | 6.76 | −0.024 |
| Rev. B | 3.1 | 10.8 | 17.9 | 1.8 | 1.8 | 2.0 | −3.19 | −0.018 |
| Rev. C | 3.1 | 11.9 | 13.4 | 1.8 | 1.8 | 2.0 | −2.04 | −0.015 |
| Rev. D | 3.1 | 19.8 | 22.9 | 1.8 | 1.8 | 2.0 | −0.25 | |
| Rev. E | 3.1 | 21.8 | 13.4 | 1.8 | 1.8 | 2.0 | −0.17 | −0.013 |
| Rev. F | 3.1 | 6.9 | 15.5 | 1.8 | 1.8 | 2.0 | −2.97 | |
| Rev. G | 3.1 | 8.9 | 17.0 | 1.8 | 1.8 | 1.8 | −3.30 | −0.020 |
| Rev. H | 3.1 | 11.9 | 18.7 | 1.8 | 1.8 | 1.8 | −2.70 | |
| Rev. I | 3.1 | 13.9 | 19.8 | 1.8 | 1.8 | 1.8 | −1.90 | |
| Rev. J | 3.1 | 8.9 | 17.0 | 1.8 | 1.8 | 1.8 | −3.22 | −0.024 |
| Rev. K | 3.1 | 8.9 | 17.0 | 2.0 | 2.0 | 2.0 | −2.41 | −0.021 |
| Rev. L | 3.1 | 8.9 | 17.0 | 1.8 | 1.8 | 1.8 | −2.46 | −0.020 |
| Rev. M | 3.1 | 9.0 | 17.0 | 1.8 | 1.8 | 1.8 | −1.27 | −0.023 |
| Rev. N | 2.6 | 8.9 | 17.0 | 1.8 | 1.9 | 2.1 | −0.95 | −0.017 |
| Rev. O | 3.1 | 8.9 | 17.0 | 1.8 | 1.9 | 2.1 | −1.56 | −0.029 |

In Table 1, the entry for "B 2.0" represents data corresponding to a Burner® 2.0 4 iron golf club. The "ICT Peak" is the thickness of the ICT Region at its inner span 142, 242. The "ICT x-loc" is the club head face plane 125, 225 coordinate (in mm) along the CG x-axis of the center 152, 252 of the ICT Region. The "ICT y-loc" is the distance (in mm) within the club head face plane 125, 225 that the center of the ICT Region is offset from the leading edge (defined as the intersection of the sole portion 108, 208 and the face plane 125, 225). The "Toe/Heel Thk," "Top thk," and "Bottom thk" are the thicknesses of the periphery of the unsupported face region 146, 246 in the areas of the toe and heel, top line, and sole portion, respectively. "Deviation" is the deviation from the target of a simulated golf ball struck by the club head, with positive numbers representing a rightward deviation (for right handed shots) and negative numbers representing a leftward deviation (for right handed shots). "Relative COR" is the predicted relative COR value for the club head.

Figure 5A:
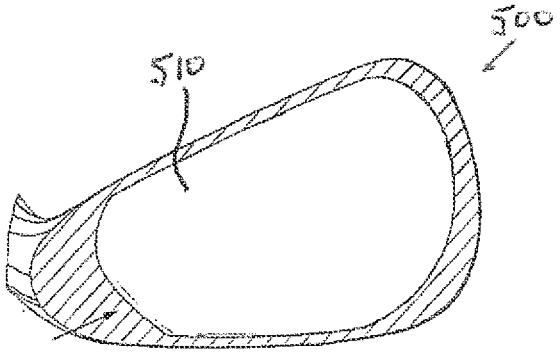
FIGS. 5A-5F are rear cross-sectional views of embodiments of golf club heads.
Figure 5B:
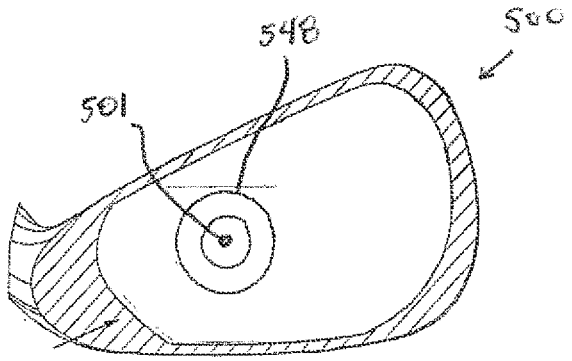

As the data contained in Table 1 shows, a thickened ICT Region 142, 242 located on the striking face 110, 210 of a high-COR iron can be located such that the occurrence of a rightward deviation can be compensated for and/or overcome. In particular, the rightward deviation is compensated for and/or overcome where the ICT region 148, 248 is located on the toe side of and near to the ideal striking location 101, 201. Examples of club heads 500 having ICT Regions 548 that are centered in the toe unsupported face region 464 are shown by comparing the club heads shown in FIGS. 5A-B with those shown in FIGS. 5C-F. The club head 500 shown in FIG. 5A does not include an ICT Region or any other localized stiffened region, instead comprising a striking face 510 having a uniform thickness. The club head 500 shown in FIG. 5B, on the other hand, includes an ICT Region 548 that is centered on the ideal striking location 501 of the club head (ICT x-loc 0.0 mm, ICT y-loc 16.5 mm). The locations of the ICT Region 548 for the club heads shown in FIGS. 5C-F are listed in Table 2:

TABLE 2

Figure 5C:
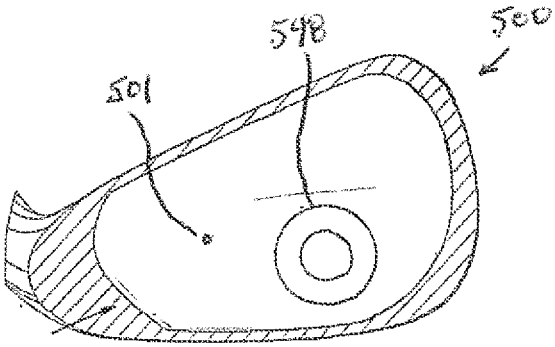
Figure 5D:
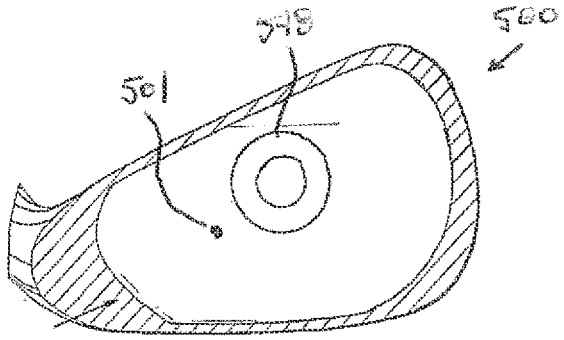
Figure 5E:
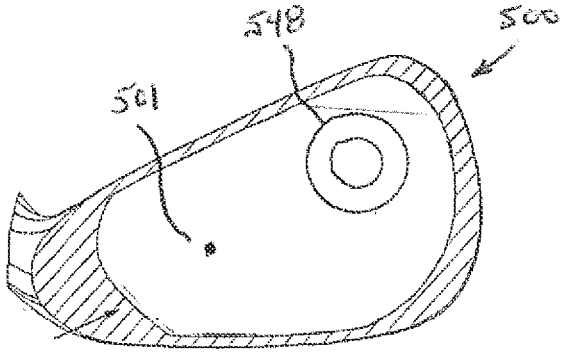
Figure 5F:
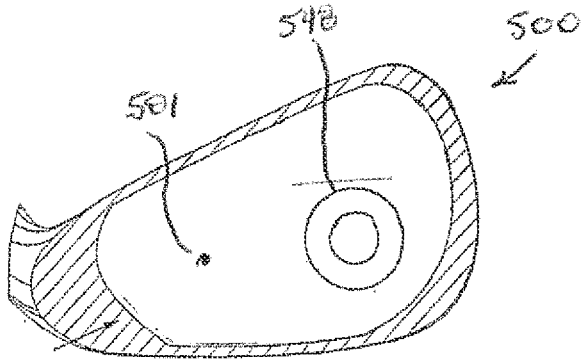

| | ICT x-loc (mm) | ICT y-loc (mm) |
|---|---|---|
| FIG. 5C | 10.0 | 18.0 |
| FIG. 5D | 7.1 | 21.4 |
| FIG. 5E | 18.0 | 27.0 |
| FIG. 5F | 20.0 | 18.0 |

Figure 6:
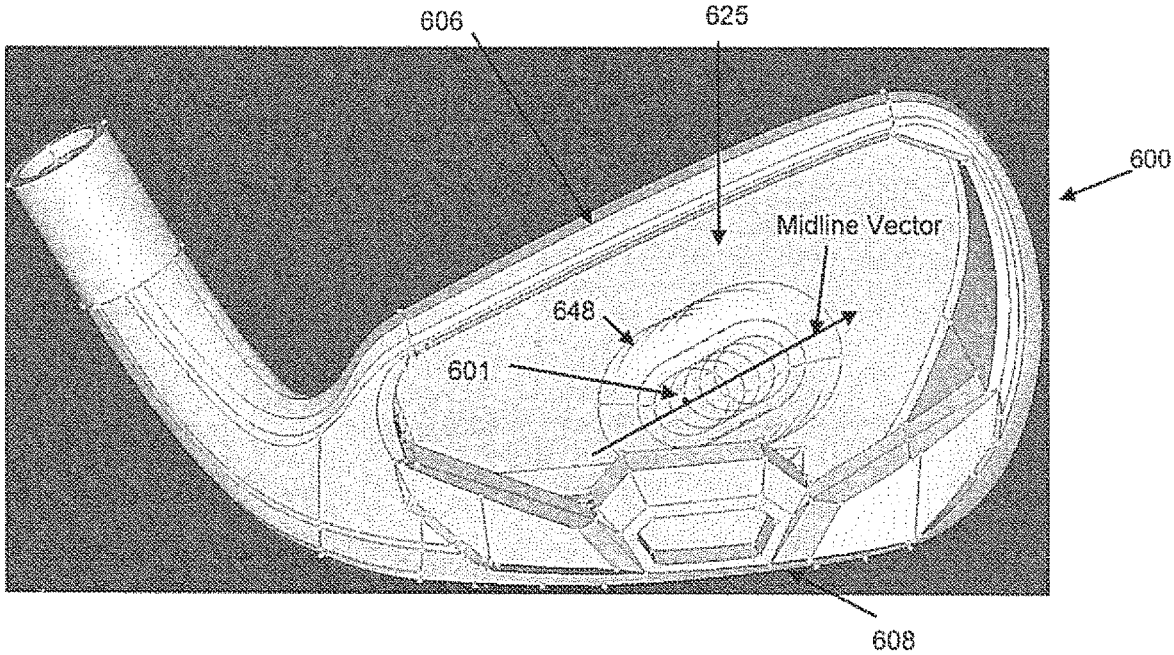
FIG. 6 is an isometric view of a golf club head showing several alternative locations of a localized stiffened region centered upon a Midline Vector.
Figure 7:
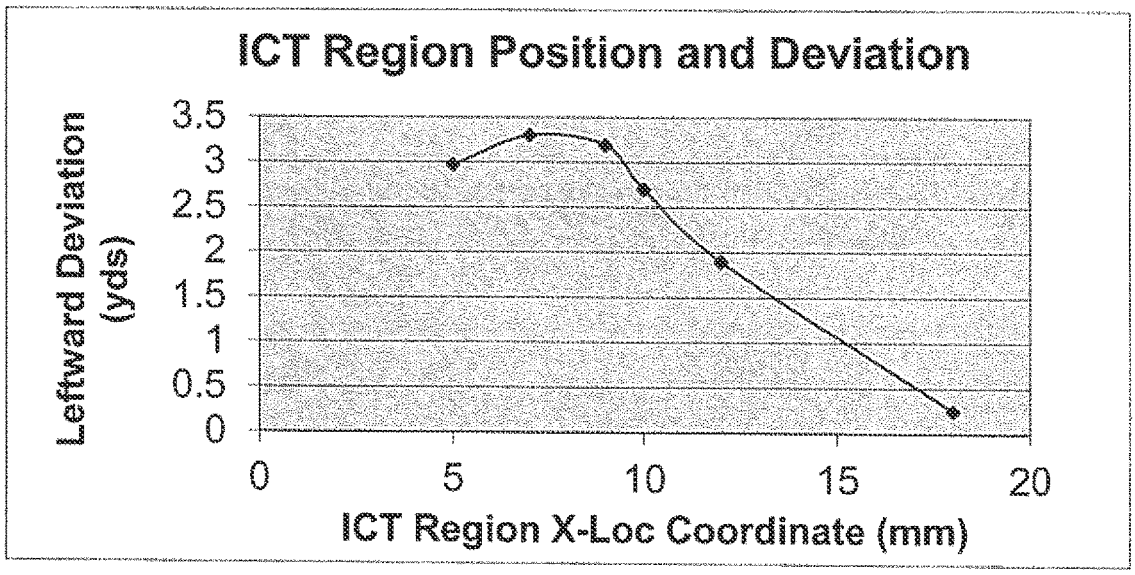
FIG. 7 illustrates a graph of a frequency response of exemplary golf club heads.

Additional data representing simulated golf ball strikes for the club head designs described above is presented in the graph contained in FIG. 7. The graph shows the amount of leftward deviation (for a right handed swing) that was observed for shots from a club head as an ICT Region 648 is shifted toe-ward and top line-ward along a Midline Vector that extends in the face plane 625 through the set of points defining a midline between the top line 606 and the sole portion 608. (See FIG. 6). As shown in the graph, as the ICT Region is shifted toe-ward and top line-ward along the Midline Vector, the amount of leftward deviation reaches a peak at an x-loc coordinate of about 7 mm to about 7.5 mm, and then dissipates substantially as the x-loc coordinate approaches 20 mm.

As discussed above, the primary cause of the observed compensation for the rightward deviation or the occurrence of a leftward deviation is the decrease or elimination of the occurrence of a rightward-tending sidespin, or the increase of the occurrence of a leftward-tending sidespin, on golf balls struck by the inventive golf club heads. Analytical testing was conducted to determine the relationship between the amount and direction of sidespin and the location of a localized stiffened region (such as an ICT Region) on the club head. Table 3 below reports the results of this testing for the inventive club head designs described in Table 1 above. As used herein, positive values for sidespin refer to a clockwise spin (from a frame of reference located above the golf ball) that produces a rightward (i.e., "slice" or "fade") deviation for right handed golf shots, and negative values for sidespin refer to a counter-clockwise spin (from a frame of reference located above the golf ball) that produces a leftward (i.e., "hook" or "draw") deviation for right handed golf shots.

TABLE 3

| ID | Deviation (yds) | Side spin (rpm) |
|---|---|---|
| B 2.0 | 6.76 | 158.23 |
| Rev. B | −3.19 | −91.45 |
| Rev. C | −2.04 | −61.16 |
| Rev. D | −0.25 | −24.56 |
| Rev. E | −0.17 | −24.74 |
| Rev. F | −2.97 | −88.27 |
| Rev. G | −3.30 | −94.31 |
| Rev. H | −2.70 | −78.85 |
| Rev. I | −1.90 | −58.99 |
| Rev. J | −3.22 | −88.69 |
| Rev. K | −2.41 | −70.06 |
| Rev. L | −2.46 | −70.30 |
| Rev. M | −1.27 | −37.68 |
| Rev. N | −0.95 | −38.99 |
| Rev. O | −1.56 | −51.22 |

In Table 3, negative values for sidespin indicate a sidespin that creates a leftward-deviation for golf balls struck right-handed.

The foregoing results were confirmed via robot testing. A commercial swing robot was used in conjunction with a three-dimensional optical motion analysis system, such as is available from Qualisys, Inc. The motion analysis system was electronically connected to a processor, which was used to collect club head and ball launch parameters as the golf clubs were swung by the robot to launch golf balls. Two golf club head designs were tested. The first was a commercially available TaylorMade Burner® 2.0 4 iron, and the second was a 4 iron embodiment of the inventive golf club heads described herein. The inventive club embodiment (Example 1 or "Ex. 1") included the following values for the parameters described:

| ID | ICT Peak (mm) | ICT x-loc (mm) | ICT y-loc (mm) | Toe/Heel thk (mm) | Top thk (mm) | Bottom thk (mm) | Relative COR |
|---|---|---|---|---|---|---|---|
| Ex. 1 | 3.1 | 6.6 | 17.2 | 1.7 | 1.7 | 1.9 | −0.010 |

For the Example 1 inventive club, the ICT region 148, 248 included an inner diameter of about 11 mm and an outer diameter of about 40 mm.

The swing robot was set up to provide a swing path of 0 degrees and a face angle of 0 degrees. The following ball launch parameters were observed and recorded for TaylorMade TP Red™ golf balls struck by the club heads at their ideal striking locations:

TABLE 4

| | Burner ® 2.0 | Ex. 1 |
|---|---|---|
| Ball Speed (mph) | 136.40 (±0.55) | 137.00 (±0.00) |
| Launch angle (deg) | 18.12 (±0.08) | 17.60 (±0.08) |
| Back spin (rpm) | 4293.20 (±54.78) | 4517.00 (±54.78) |
| Side spin (rpm) | 173.60 (±133.48) | −176.80 (±133.48) |

As the results above show, the inventive golf club head (which has a localized stiffened region that is shifted toe-ward and top line-ward relative to the ICT Region of the Burner® 2.0 club head) produced about 350.4 rpm of increased leftward-tending sidespin relative to the Burner® 2.0 golf club head.

A. Full Unsupported Face Region Stiffness

As noted above, previous high-COR, perimeter weighted, iron type golf club head designs have included an unsupported face region in which the cross-sectional bending stiffness is generally uniformly distributed relative to the ideal striking location. For example, a club head with a striking plate having a uniform thickness of a homogeneous material will have the same point-wise cross-sectional bending stiffness at each point within the unsupported face region. As another example, a club head having a localized stiffened region (e.g., an ICT Region) that is symmetric and that is centered upon the ideal striking location will also have a point-wise cross-sectional bending stiffness that is generally uniformly distributed relative to the ideal striking location. In the latter example, the point-wise cross-sectional bending stiffness will vary at different locations on the club face, but the variations will be symmetrically distributed relative to the ideal striking location. At least the following three properties of these golf clubs are factors leading to the occurrence of a rightward deviation for golf shots hit with these clubs: (a) the high COR, (b) the asymmetric shape of the unsupported face region, and (c) the uniform bending stiffness distribution On the other hand, the inventive high-COR, perimeter weighted, iron type golf club heads described herein include a point-wise cross-sectional bending stiffness profile that is asymmetric in relation to the ideal striking location, which provides a non-uniform bending stiffness distribution that decreases or prevents the occurrence of the foregoing rightward deviation. In particular, for the inventive club head designs, the mean point-wise cross-sectional bending stiffness of the toe unsupported face region 464 (see FIG. 4) is larger than the mean point-wise cross-sectional bending stiffness of the heel unsupported face region 462. This is due to the fact that the centroid of a localized stiffened region (e.g., an ICT Region) is located relatively toe-ward of the ideal striking location 401, thereby increasing the mean point-wise cross-sectional bending stiffness of the toe unsupported face region 464 relative to that of the heel unsupported face region 462.

The mean point-wise cross-sectional bending stiffness of a member may be calculated by dividing the member into N evenly distributed points and applying the following equation:

$$\text{Mean Bending Stiffness} = \left[\left(\sum_{n=1}^{N} E_n t_n^3\right) + N\right]$$

where $E_n$ and $t_n$ are the effective Young's Modulus and effective thickness, respectively, of an nth cross-sectional subdivision of the member. In the case of an unsupported face region of a golf club striking face, a reasonable distribution is achieved by discretizing the region into a mesh of uniform cross-sections each having a 1 mm×1 mm surface on the striking face to apply the foregoing equation.

Accordingly, for the inventive club heads described herein, the following inequality will apply in a comparison of the mean bending stiffness of the toe unsupported face region 464 to the mean bending stiffness of the heel unsupported face region 462:

$$\left[\left(\sum_{n=1}^{N} E_n t_n^3\right) + N\right] + \left[\left(\sum_{m=1}^{M} E_m t_m^3\right) + M\right] > C$$

where $E_n$ and $t_n$ are the effective Young's Modulus value and the thickness, respectively, for the nth cross-section of the toe portion of the unsupported region of the striking face, $E_m$ and $t_m$ are the effective Young's Modulus value and the thickness, respectively, for the mth cross-section of the heel portion of the unsupported region of the striking face, N and M have values such that 1 $mm^2$=($SA_{TOE}$/N)=($SA_{HEEL}$/M), and C is a constant having a value of 1.1.

The foregoing analysis was applied to the Burner® 2.0 golf club and the inventive golf club head designs described herein. The results are presented in Table 5:

TABLE 5

| ID | $BS_{TOE}/BS_{HEEL}$ | Deviation (yds) | Side spin (rpm) |
|---|---|---|---|
| B 2.0 | 1.06 | 6.76 | 158.23 |
| Rev. B | 1.28 | −3.19 | −91.45 |
| Rev. C | 1.30 | −2.04 | −61.16 |
| Rev. D | 1.27 | −0.25 | −24.56 |
| Rev. E | 1.34 | −0.17 | −24.74 |
| Rev. F | 1.29 | −2.97 | −88.27 |
| Rev. G | 1.28 | −3.30 | −94.31 |
| Rev. H | 1.26 | −2.70 | −78.85 |
| Rev. I | 1.27 | −1.90 | −58.99 |
| Rev. J | 1.69 | −3.22 | −88.69 |
| Rev. K | 1.23 | −2.41 | −70.06 |
| Rev. L | 1.51 | −2.46 | −70.30 |
| Rev. M | 1.25 | −1.27 | −37.68 |
| Rev. N | 1.22 | −0.95 | −38.99 |
| Rev. O | 1.37 | −1.56 | −51.22 |

As these results show, the inventive golf club head designs provide a ratio of mean bending stiffness of the toe unsupported face region ($BS_{TOE}$) to mean bending stiffness of the heel unsupported face region ($BS_{HEEL}$) that is greater than 1.1. For some embodiments, the ratio of $BS_{TOE}/BS_{HEEL}$ is greater than about 1.15. In other embodiments, the ratio of $BS_{TOE}/BS_{HEEL}$ is greater than about 1.20. In still other embodiments, the ratio of $BS_{TOE}/BS_{HEEL}$ is greater than about 1.25.

B. Hitting Region Stiffness

As noted above in relation to the data presented in FIG. 7, as the localized stiffened region is shifted toe-ward and top line-ward along the Midline Vector, the amount of leftward deviation generally reaches a peak at an x-loc coordinate of about 7 mm to about 7.5 mm, and then dissipates substantially as the x-loc coordinate approaches 20 mm. This observation illustrates that locating the localized stiffened region within a "hitting region" near to the ideal striking location will have a more significant impact on the occurrence of the rightward deviation described above. Thus, analysis of the bending stiffness profiles within the "hitting region" can show whether the club head construction will reduce and/or overcome the occurrence of the rightward deviation described above.

Two examples of "hitting regions" are defined herein for the purpose of analyzing a given iron type club head. In a first example, a "vertical wall hitting region" is defined as the portion of the unsupported face region that extends between two imaginary parallel lines drawn within the face plane 125, 225, perpendicularly to the ground plane 111, and spaced 20 mm on either side of the ideal striking location 101, 201. In a second example, a "circular wall hitting region" is defined as the portion of the unsupported face region that extends within an imaginary circle drawn within the face plane 125, 225, having a radius of 20 mm, and having a center located at the ideal striking location 101, 201.

The bending stiffness equations described in the preceding section can then be applied to the "hitting regions" defined above for a given iron type golf club head. In particular, for the inventive club heads described herein, the following inequality will apply in a comparison of the mean bending stiffness of the portion of the toe unsupported face region 464 to the mean bending stiffness of the portion of the heel unsupported face region 462 that lie within the specified "hitting region" of the golf club head:

$$\left[\left(\sum_{n=1}^{N} E_n t_n^3\right) + N\right] + \left[\left(\sum_{m=1}^{M} E_m t_m^3\right) + M\right] > D$$

where $E_n$ and $t_n$ are the effective Young's Modulus value and the thickness, respectively, for the nth cross-section of the toe portion of the unsupported region of the striking face lying within the hitting region, $E_m$ and $t_m$ are the effective Young's Modulus value and the thickness, respectively, for the mth cross-section of the heel portion of the unsupported region of the striking face lying within the hitting region, N and M have values determined by discretizing $SA_{TOE\ HR}$ and $SA_{HEEL\ HR}$, respectively, into 1 mm×1 mm sections, $SA_{TOE\ HR}$ and $SA_{HEEL\ HR}$ are the surface area of the toe portion and heel portion, respectively, of the unsupported region of the striking face lying with the hitting region, and D has a value defined below.

The foregoing analysis was applied to the Burner® 2.0 golf club and the inventive golf club head designs described herein. The results are presented in Table 5:

TABLE 6

| ID | $BS_{TOE}/BS_{HEEL}$ (Vert Wall HR) | $BS_{TOE}/BS_{HEEL}$ (Circle HR) | Deviation (yds) | Side spin (rpm) |
|---|---|---|---|---|
| B 2.0 | 1.16 | 1.25 | 6.76 | 158.23 |
| Rev. B | 1.52 | 1.81 | −3.19 | −91.45 |
| Rev. C | 1.55 | 1.84 | −2.04 | −61.16 |
| Rev. D | 1.32 | 1.40 | −0.25 | −24.56 |
| Rev. E | 1.28 | 1.39 | −0.17 | −24.74 |
| Rev. F | 1.54 | 1.83 | −2.97 | −88.27 |
| Rev. G | 1.51 | 1.80 | −3.30 | −94.31 |
| Rev. H | 1.47 | 1.74 | −2.70 | −78.85 |
| Rev. I | 1.49 | 1.76 | −1.90 | −58.99 |
| Rev. J | 2.22 | 2.76 | −3.22 | −88.69 |
| Rev. K | 1.40 | 1.57 | −2.41 | −70.06 |
| Rev. L | 1.81 | 2.09 | −2.46 | −70.30 |
| Rev. M | 1.50 | 1.76 | −1.27 | −37.68 |
| Rev. N | 1.40 | 1.54 | −0.95 | −38.99 |
| Rev. O | 1.64 | 1.83 | −1.56 | −51.22 |

As for the value of the constant D in the inequality set forth above, the results reported in Table 6 show that, in the case of the "vertical wall hitting region" (i.e., $D_{VW}$) the inventive golf club head designs provide a ratio of mean bending stiffness of the toe unsupported face region lying in the hitting region ($BS_{TOE\ HR}$) to mean bending stiffness of the heel unsupported face region lying in the hitting region ($BS_{HEEL\ HR}$) such that $D_{VW}$ is greater than 1.25. For some embodiments of the "vertical wall hitting region," the ratio of $BS_{TOE\ HR}/BS_{HEEL\ HR}$ is greater than about 1.30. In other embodiments, the ratio of $BS_{TOE\ HR}/BS_{HEEL\ HR}$ is greater than about 1.40. In still other embodiments, the ratio of $BS_{TOE\ HR}/BS_{HEEL\ HR}$ is greater than about 1.50.

Turning next to the case of the "circular wall hitting region" (i.e., $D_{CW}$), the inventive golf club head designs provide a ratio of mean bending stiffness of the toe unsupported face region lying in the hitting region ($BS_{TOE\ HR}$) to mean bending stiffness of the heel unsupported face region lying in the hitting region ($BS_{HEEL\ HR}$) such that the value of $D_{CW}$ is greater than 1.40. For some embodiments of the "circular wall hitting region," the ratio of $BS_{TOE\ HR}/BS_{HEEL\ HR}$ is greater than about 1.50. In other embodiments, the ratio of $BS_{TOE\ HR}/BS_{HEEL\ HR}$ is greater than about 1.65. In still other embodiments, the ratio of $BS_{TOE\ HR}/BS_{HEEL\ HR}$ is greater than about 1.80.

C. Application of Gaussian Weighting Function

An alternative analytical description of the bending stiffness distribution of the inventive golf club heads described herein incorporates a Gaussian function. Gaussian functions are used in statistics to described normal distributions, e.g., a characteristic symmetric "bell curve" shape that quickly falls off towards plus/minus infinity. For the purposes described herein, the Gaussian function is used to apply a distributive weighting to the bending stiffness contribution of cross-sectional subdivisions of the striking face in an analytical description of the golf club face construction. Similar to the "hitting region" analysis described in the preceding section, an analysis of the bending stiffness profiles using a Gaussian weighting function can show whether the club head construction will reduce and/or overcome the occurrence of the rightward deviation described above.

The two-dimensional elliptical Gaussian function has the following form:

$$f(x,y)=Ae^{-(a(x-x_0)^2+2b(x-x_0)(y-y_0)+c(x-x_0)^2)}$$

where A is the height of the peak of the function centered at $(x_0, y_0)$ and a, b, and c are the following:

$$a=(\cos^2\theta\div 2\sigma_x^2)+(\sin^2\theta\div 2\sigma_y^2)$$

$$b=(\sin 2\ \theta\div 4\sigma_x^2)+(\sin 2\ \theta\div 4\sigma_y^2)$$

$$c=(\sin^2\theta\div 2\sigma_x^2)+(\cos^2\theta\div 2\sigma_y^2)$$

Where $\sigma_x$ and $\sigma_y$ are the full width half maxima of the weighting function. This allows the weighting function to be rotated about a specified angle θ. In the case of a description of the inventive golf club heads described herein, the following set of parameters are used to define the function:

A=1;

$x_0$=7 mm toe-ward from the ideal striking location;

$y_0$=22 mm upward from the mid-point of the sole of the club head;

$\sigma_x$=15 mm;

$\sigma_y$=20 mm; and

θ=30 degrees.

The foregoing set of parameters was determined based upon analysis of the simulation and testing data presented above which was used to identify the location on the striking face of the golf club where a localized stiffened region would be most influential in inducing the occurrence of a leftward deviation for golf balls struck by the club head.

The Gaussian weighting function, f(x, y), so defined is then applied to the bending stiffness equations and inequalities described above to determine the weighted mean bending stiffness of a region of the striking face of a golf club according to the following:

$$\text{Weighted Mean Bending Stiffness} = \left[\left(\sum_{n=1}^{N} E_n t_n^3 \times f(x, y)\right) + N\right]$$

where $E_n$ and $t_n$ are the effective Young's Modulus and effective thickness, respectively, of an nth cross-sectional subdivision of the region.

Accordingly, for the inventive club heads described herein, the following inequality will apply in a comparison of the mean bending stiffness of the toe unsupported face region 464 to the mean bending stiffness of the heel unsupported face region 462:

$$\left[\left(\sum_{n=1}^{N} E_n t_n^3 \times f(x, y)\right) + N\right] + \left[\left(\sum_{m=1}^{M} E_m t_m^3 \times f(x, y)\right) + M\right] > F$$

where $E_n$ and $t_n$ are the effective Young's Modulus value and the thickness, respectively, for the nth cross-section of the toe portion of the unsupported region of the striking face, $E_m$ and $t_m$ are the effective Young's Modulus value and the thickness, respectively, for the mth cross-section of the heel portion of the unsupported region of the striking face, N and M have values determined by discretizing $SA_{TOE}$ and $SA_{HEEL}$, respectively, into 1 mm×1 mm sections, f(x, y) is the Gaussian weighting function defined above, and F has a value defined below.

The foregoing analysis was applied to the Burner® 2.0 golf club and the inventive golf club head designs described herein. The results are presented in Table 7:

TABLE 7

| ID | $BS_{TOE\ WEIGHTED}/BS_{HEEL\ WEIGHTED}$ | Deviation (yds) | Side spin (rpm) |
|---|---|---|---|
| B 2.0 | 3.01 | 6.76 | 158.23 |
| Rev. B | 4.97 | −3.19 | −91.45 |
| Rev. C | 4.50 | −2.04 | −61.16 |
| Rev. D | 3.55 | −0.25 | −24.56 |
| Rev. E | 4.06 | −0.17 | −24.74 |

TABLE 7-continued

| ID | $BS_{TOE\ WEIGHTED}$/ $BS_{HEEL\ WEIGHTED}$ | Deviation (yds) | Side spin (rpm) |
|---|---|---|---|
| Rev. F | 4.84 | −2.97 | −88.27 |
| Rev. G | 5.10 | −3.30 | −94.31 |
| Rev. H | 4.80 | −2.70 | −78.85 |
| Rev. I | 4.77 | −1.90 | −58.99 |
| Rev. J | 5.04 | −3.22 | −88.69 |
| Rev. K | 4.41 | −2.41 | −70.06 |
| Rev. L | 4.50 | −2.46 | −70.30 |
| Rev. M | 3.79 | −1.27 | −37.68 |
| Rev. N | 3.40 | −0.95 | −38.99 |
| Rev. O | 3.62 | −1.56 | −51.22 |

As these results show, the inventive golf club head designs provide a ratio of the weighted mean bending stiffness of the toe unsupported face region ($BS_{TOE\ WEIGHTED}$) to weighted mean bending stiffness of the heel unsupported face region ($BS_{HEEL\ WEIGHTED}$) that satisfies the above inequality where F is equal to 3.10. For some embodiments, the ratio of $BS_{TOE\ WEIGHED}/BS_{HEEL\ WEIGHTED}$ is greater than about 3.40 (i.e., F=3.40). In other embodiments, the ratio of $BS_{TOE}/BS_{HEEL}$ is greater than about 4.00 (i.e., F=4.00). In still other embodiments, the ratio of $BS_{TOE}/BS_{HEEL}$ is greater than about 4.40 (i.e., F=4.40).

D. Sidespin Performance Value

As discussed above, testing and analysis of the currently available iron type golf clubs confirms that those currently available golf clubs with club heads having a high COR and an asymmetric unsupported face region will have the rightward deviation (for right handed golf shots) caused by a rightward sidespin described above. As used herein, the term "high COR" refers to a relative COR of at least about −0.030, such as at least about −0.025 or, in some embodiments, at least about −0.020. Also, as used herein, the term "asymmetric unsupported face region" refers to an unsupported face region in which $SA_{TOE}>SA_{HEEL}$, as those terms are defined above in relation to FIG. 4.

The inventive club heads described herein also have high COR and an asymmetric unsupported face region. However, testing has shown that the inventive club heads do not have the rightward deviation caused by rightward sidespin of the previous club heads. For example, as discussed above, a commercial swing robot was used in conjunction with a three-dimensional optical motion analysis system, such as is available from Qualisys, Inc., to compare the inventive club heads with a previous high COR club head having an asymmetric unsupported face region. The motion analysis system was electronically connected to a processor, which was used to collect club head and ball launch parameters as the golf clubs were swung by the robot to launch golf balls. The commercial golf club tested was a TaylorMade Burner® 2.0 4 iron, which was compared to the "Example 1" 4 iron embodiment of the inventive golf club heads described above. The swing robot was set up to provide a swing path of 0 degrees and a face angle of 0 degrees. The following ball launch parameters were observed and recorded for TaylorMade TP Red™ golf balls struck by the club heads at their ideal striking locations:

TABLE 4

| | Burner ® 2.0 | Ex. 1 |
|---|---|---|
| Ball Speed (mph) | 136.40 (±0.55) | 137.00 (±0.00) |
| Launch angle (deg) | 18.12 (±0.08) | 17.60 (±0.08) |

TABLE 4-continued

| | Burner ® 2.0 | Ex. 1 |
|---|---|---|
| Back spin (rpm) | 4293.20 (±54.78) | 4517.00 (±54.78) |
| Side spin (rpm) | 173.60 (±133.48) | −176.80 (±133.48) |

As the results above show, the inventive golf club head (which has a localized stiffened region that is shifted toeward and top line-ward relative to the ICT Region of the Burner® 2.0 club head) produced about 350.4 rpm of increased leftward-tending sidespin relative to the Burner® 2.0 golf club head.

Moreover, the inventive club head produced a Sidespin Performance Value that is less than 0. As used herein, the term "Sidespin Performance Value" for a given iron type golf club head refers to the sidespin of a golf ball struck by the subject club head using a conventional swing robot as measured using a conventional three-dimensional motion analysis system under the following set of "Specified Set Up and Launch Conditions":

Swing Path: 0 degrees

Face Angle: 0 degrees

Head Speed (mph): 112−0.56×(Loft)

Launch Angle: Less than static loft of club head;

Ball Speed (mph): 178.8−1.27×(Loft)>Ball Speed>142.8−1.27×(Loft)

Backspin (rpm): 283.33×(Loft)+400>Backspin>200×(Loft)−2100

The Specified Set Up and Launch Conditions include Ball Speed and Backspin launch conditions that are expressed as a function of the static loft ("Loft") of the club head being tested (in degrees), thereby providing the ability to test club heads having a wide range of static lofts. The golf ball used to determine the Sidespin Performance Value of a subject club head is one that is included in the USGA list of Conforming Golf Balls.

E. Localized Stiffened Region

Several embodiments of the inventive golf club heads described herein include a localized stiffened region that is located on and that forms a portion of the striking face 110, 210 at a location that surrounds or that is adjacent to the ideal striking location 101, 201. The localized stiffened region comprises an area of the striking face 110, 210 that has increased stiffness due to being relatively thicker than a surrounding region, due to being constructed of a material having a higher Young's Modulus (E) value than a surrounding region, and/or a combination of these factors.

In addition to the location of the localized stiffened region on the striking face of the club head, the localized stiffened regions of the inventive golf club heads can be described by reference to the mean bending stiffness of the localized stiffened region relative to the mean bending stiffness of the unsupported region face region of the club head. For example, the mean point-wise cross-sectional bending stiffness of a given localized stiffened region may be calculated according to the following equation:

$$\text{Mean Bending Stiffness} = \left[\left(\sum_{n=1}^{N} E_n t_n^3\right) + N\right]$$

where $E_n$ and $t_n$ are the effective Young's Modulus and effective thickness, respectively, of an $n^{th}$ cross-sectional subdivision of the localized stiffened region, and where the localized stiffened region is subdivided into a mesh of 1 mm×1 mm cross-sections to apply the foregoing equation.

Accordingly, for the inventive club heads described herein, the following inequality will apply:

$$\left[\left(\sum_{n=1}^{N} E_n t_n^3\right) + N\right] + \left[\left(\sum_{m=1}^{M} E_m t_m^3\right) + M\right] > G$$

where $E_n$ and $t_n$ are the effective Young's Modulus value and the thickness, respectively, for the $n^{th}$ cross-section of the localized stiffened region of the striking face, $E_m$ and $t_m$ are the effective Young's Modulus value and the thickness, respectively, for the $m^{th}$ cross-section of the unsupported region of the striking face, N and M have values determined by discretizing $SA_{LSR}$ and $SA_{UR}$, respectively, into 1 mm×1 mm sections where $SA_{LSR}$ is the surface area of the localized stiffened region and $SA_{UR}$ is the surface area of the unsupported region, and G is a constant having a value of at least 1.6, such as 1.75, 2.0, 2.2, 2.5, or 3.0.

In several embodiments of the inventive golf club heads described herein, the localized stiffened region is an inverted cone technology region having a symmetrical "donut" shaped area of increased thickness that has a center located toe-ward of the ideal striking location 101, 201. In some of these embodiments, the inverted cone region 148, 248 includes an outer span 144, 244 having a diameter of between about 15 mm and about 25 mm, or at least about 20 mm. In some embodiments, the inner span 142, 242 has a diameter of between about 5 mm and about 15 mm, or at least about 10 mm. Several such embodiments are described in Table 1 above.

In several other embodiments of the inventive golf club head described herein, the localized stiffened region has a shape and size other than those described above for the inverted cone regions 148, 248. The shape may be geometric (e.g., triangular, square, trapezoidal, etc.) or irregular. For these embodiments, a center of gravity of the localized stiffened region ($CG_{LSR}$) may be determined, with the $CG_{LSR}$ being located toe-ward of the ideal striking location.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club head comprising:

a heel;

a toe;

a sole;

a top-line of the club head;

a striking face having a forward-facing ball-striking surface, a rearward-facing surface, and a striking location; and a perimeter weight at least partially surrounding the striking face;

wherein the striking face has a first region supported by the perimeter weight and a second region, with the striking location lying within the second region;

wherein a heel portion of the second region of the striking face is located on a heel side of an imaginary vertical plane that extends perpendicularly to a ground plane and that contains an imaginary line that extends in a direction normal to the striking face at the striking location when the club head is in the normal address position, and wherein a toe portion of the second region of the face is located on a toe side of the imaginary plane;

wherein $SA_{TOE}$ is defined as the surface area of the toe portion of the second region;

wherein $SA_{HEEL}$ is defined as the surface area of the heel portion of the second region;

wherein the club head has a relative coefficient of restitution that is in a range from −0.030 to 0.000; and wherein the following inequality is satisfied:

$$[(\Sigma_{n=1}^{N} E_n t_n^3) \div N][(\Sigma_{m=1}^{M} E_m t_m^3) \div M] > 1.1; \quad (1)$$

wherein:

$E_n$ and $t_n$ are the effective Young's Modulus value and the thickness, respectively, for the $n^{th}$ cross-section of the toe portion of the second region of the striking face;

$E_m$ and $t_m$ are the effective Young's Modulus value and the thickness, respectively, for the $m^{th}$ cross-section of the heel portion of the second region of the striking face; and N and M have values determined by discretizing $SA_{TOE}$ and a $SA_{HEEL}$, respectively, into 1 mm×1 mm sections;

wherein a localized stiffened region of the striking face is located at least partially toe-ward of the striking location; and wherein the sole has a sole thickness that is less than a thickness of a localized stiffened region.

2. The club head of claim 1, further comprising a badge coupled to the rearward-facing surface of the striking face, wherein the badge covers a majority of the rearward-facing surface, the badge has a variable thickness, and the badge covers one or more weld beads on the rearward-facing surface of the striking face.

3. The club head of claim 1, wherein the sole has a sole thickness dimension that is less than 1.7 mm and the localized stiffened region of the striking face has a thickness ranging from 1.7 mm to 3.5 mm.

4. The club head of claim 3, wherein the sole has a sole thickness dimension that is between about 1 mm and about 2 mm.

5. The club head of claim 4, wherein a second portion of the striking face spaced from the localized stiffened region of the striking face has a face thickness ranging from 1.5 mm to 3.0 mm.

6. The club head of claim 5, wherein the localized stiffened region of the striking face has a thickness of 3.1 mm or less, and the second portion of the striking face has a thickness of 2 mm or less.

7. The club head of claim 3, wherein the club head has a COR value of no less than 0.825.

8. The club head of claim 7, wherein the striking face is welded to other portions of the golf club head.

9. The club head of claim 3, wherein a lower toe region of the striking face is thicker than an upper toe region of the striking face.

10. The club head of claim 1, wherein a lower toe region of the striking face is thicker than an upper toe region of the striking face.

11. The club head of claim 1, wherein the golf club head is a cavity back iron golf club head.

12. The club head of claim 1, wherein the club head includes a cavity that contains a filler material that has a density between about 0.03 and 0.19 g/cm$^3$, and at least one weighting element is located on the club head to adjust a center of gravity of the club head.

13. The club head of claim 12, wherein a lower toe region of the striking face is thicker than an upper toe region of the striking face.

14. A golf club head comprising:

a heel;

a toe;

a sole;

a top-line of the club head;

a striking face having a forward-facing ball-striking surface, a rearward-facing surface, and a striking location; and a perimeter weight that at least partially surrounds the striking face;

wherein the striking face has a first region supported by the perimeter weight and a second region, with the striking location lying within the second region;

wherein a heel portion of the second region of the striking face is located on a heel side of an imaginary vertical plane that extends perpendicularly to a ground plane and that contains an imaginary line that extends in a direction normal to the striking face at the striking location when the club head is in the normal address position, and wherein a toe portion of the second region of the face is located on a toe side of the imaginary plane;

wherein the club head has a relative coefficient of restitution that is in a range from −0.030 to 0.000;

wherein $SA_{TOE}$ is defined as the surface area of the toe portion of the second region;

wherein $SA_{HEEL}$ is defined as the surface area of the heel portion of the second region;

wherein the following inequality is satisfied:

$$[(\Sigma_{n=1}^{N} E_n t_n^3) \div N][(\Sigma_{m=1}^{M} E_m t_m^3) \div M] > 1.1; \quad (1)$$

wherein:

$E_n$ and $t_n$ are the effective Young's Modulus value and the thickness, respectively, for the $n^{th}$ cross-section of the toe portion of the second region of the striking face;

$E_m$ and $t_m$ are the effective Young's Modulus value and the thickness, respectively, for the $m^{th}$ cross-section of the heel portion of the second region of the striking face; and N and M have values determined by discretizing $SA_{TOE}$ and a $SA_{HEEL}$, respectively, into 1 mm×1 mm sections;

wherein the club head includes a cavity that contains a filler material; and wherein at least one weighting element is located on the club head to adjust a center of gravity of the club head;

wherein the sole has a sole thickness dimension that is less than 1.7 mm; and wherein the sole has a sole thickness that is less than a thickness of a localized stiffened region of the striking face.

15. The club head of claim 14, further comprising a badge coupled to the rearward-facing surface of the striking face, wherein the badge covers a majority of the rearward-facing surface, wherein the badge has a variable thickness, and wherein the badge covers one or more weld beads on the rearward-facing surface of the striking face.

16. The club head of claim 14, wherein the sole has a sole thickness dimension that is between about 1 mm and about 1.7 mm.

17. The club head of claim 14, wherein the localized stiffened region of the striking face has a thickness ranging from 1.7 mm to 3.5 mm, and second portion of the striking face spaced from the localized stiffened region of the striking face has a face thickness ranging from 1.5 mm to 3.0 mm.

18. The club head of claim 17, wherein the localized stiffened region of the striking face has a thickness of 3.1 mm or less, and the second portion of the striking face has a thickness of 2 mm or less.

19. The club head of claim 14, wherein the club head has a COR value of no less than 0.825.

20. The club head of claim 14, wherein the striking face is welded to other portions of the golf club head, and the striking face comprises forged 4140 steel.

21. The club head of claim 14, wherein a lower toe region of the striking face is thicker than an upper toe region of the striking face.

22. A golf club head comprising:

a heel;

a toe;

a sole;

a top-line of the club head;

a striking face having a forward-facing ball-striking surface, a rearward-facing surface, and a striking location; and a perimeter weight at least partially surrounding the striking face;

wherein the striking face has a first region supported by the perimeter weight and a second region, with the striking location lying within the second region;

wherein a heel portion of the second region of the striking face is located on a heel side of an imaginary vertical plane that extends perpendicularly to a ground plane and that contains an imaginary line that extends in a direction normal to the striking face at the striking location when the club head is in the normal address position, and wherein a toe portion of the second region of the face is located on a toe side of the imaginary plane;

wherein $SA_{TOE}$ is defined as the surface area of the toe portion of the second region;

wherein $SA_{HEEL}$ is defined as the surface area of the heel portion of the second region;

wherein the club head has a relative coefficient of restitution that is in a range from −0.030 to 0.000; and wherein the following inequality is satisfied:

$$[(\Sigma_{n=1}^{N} E_n t_n^3) \div N][(\Sigma_{m=1}^{M} E_m t_m^3) \div M] > 1.1; \quad (1)$$

wherein:

$E_n$ and $t_n$ are the effective Young's Modulus value and the thickness, respectively, for the $n^{th}$ cross-section of the toe portion of the second region of the striking face;

$E_m$ and $t_m$ are the effective Young's Modulus value and the thickness, respectively, for the $m^{th}$ cross-section of the heel portion of the second region of the striking face; and N and M have values determined by discretizing $SA_{TOE}$ and a $SA_{HEEL}$, respectively, into 1 mm×1 mm sections;

wherein a localized stiffened region of the striking face is located at least partially toe-ward of the striking location; and wherein a lower toe region of the striking face is thicker than an upper toe region of the striking face.

23. The club head of claim 22, wherein:

the club head has a COR value of no less than 0.825;

the striking face is welded to other portions of the golf club head; and the club head includes a cavity that contains a filler material that has a density between about 0.03 and 0.19 $g/cm^3$.

24. The club head of claim 22, wherein the sole has a sole thickness dimension that is less than 1.7 mm and the localized stiffened region of the striking face has a thickness ranging from 1.7 mm to 3.5 mm.

* * * * *